US008163227B2

(12) United States Patent
Sumida et al.

(10) Patent No.: US 8,163,227 B2
(45) Date of Patent: Apr. 24, 2012

(54) NANOFIBER SPINNING METHOD AND DEVICE

(75) Inventors: Hiroto Sumida, Nara (JP); Takahiro Kurokawa, Tokyo (JP); Kazunori Ishikawa, Osaka (JP); Mitsuhiro Takahashi, Ehime (JP); Mikio Takezawa, Kagawa (JP); Yoshiaki Tominaga, Kanagawa (JP)

(73) Assignee: Panasonic Corporation, Osaka (JP)

( * ) Notice: Subject to any disclaimer, the term of this patent is extended or adjusted under 35 U.S.C. 154(b) by 296 days.

(21) Appl. No.: 12/598,179

(22) PCT Filed: May 1, 2008

(86) PCT No.: PCT/JP2008/001134

§ 371 (c)(1),
(2), (4) Date: Oct. 29, 2009

(87) PCT Pub. No.: WO2008/149488

PCT Pub. Date: Dec. 11, 2008

(65) Prior Publication Data

US 2010/0148404 A1 Jun. 17, 2010

(30) Foreign Application Priority Data

May 29, 2007 (JP) ..... 2007-141907

(51) Int. Cl.

| | |
|---|---|
| ***D01D 5/18*** | (2006.01) |
| ***D02G 3/22*** | (2006.01) |
| ***D06M 10/00*** | (2006.01) |
| ***H05B 7/00*** | (2006.01) |

(52) U.S. Cl. ..... 264/465; 264/103; 264/171.13; 264/211.1

(58) Field of Classification Search ..... 264/103, 264/171.13, 211.1, 465

See application file for complete search history.

(56) References Cited

U.S. PATENT DOCUMENTS

| | | | |
|---|---|---|---|
| 6,616,435 | B2 | 9/2003 | Lee et al. |
| 7,354,546 | B2 | 4/2008 | Kim et al. |

(Continued)

FOREIGN PATENT DOCUMENTS

| | | |
|---|---|---|
| JP | 2006-507428 | 3/2002 |
| JP | 2002-201559 | 7/2002 |
| JP | 2006-291398 | 10/2006 |
| JP | 2008-088600 | 4/2008 |

(Continued)

OTHER PUBLICATIONS

International Search Report issued Aug. 12, 2008 in International (PCT) Application No. PCT/JP2008/001134.

*Primary Examiner* — Leo B Tentoni

(74) *Attorney, Agent, or Firm* — Wenderoth, Lind & Ponack, LLP

(57) ABSTRACT

A nanofiber spinning method and device for producing a high strength and uniform yarn made of nanofibers. The device includes: a nanofiber producing unit (2) which produces nanofibers (11) by extruding polymer solution, prepared by dissolving polymeric substances in a solvent, through small holes (7) and charging the polymer solution, and by allowing the polymer solution to be stretched by an electrostatic explosion, and which allows the nanofibers to travel in a single direction; a collecting electrode unit (3) to which an electric potential different from that of the charged polymer solution is applied, and which attracts the produced nanofibers (11) while simultaneously rotating and twisting the nanofibers, and gathers them for forming a yarn (20) made of the nanofibers (11); and a collecting unit (5) which collects the yarn (20) passed through the center of the collecting electrode unit (3).

4 Claims, 19 Drawing Sheets

U.S. PATENT DOCUMENTS

| | | | | |
|---|---|---|---|---|
| 2002/0122840 | A1 | 9/2002 | Lee et al. | |
| 2005/0106391 | A1* | 5/2005 | Lawrence et al. | 428/375 |
| 2005/0253305 | A1 | 11/2005 | Kim et al. | |
| 2009/0102100 | A1* | 4/2009 | Hellring et al. | 264/465 X |

FOREIGN PATENT DOCUMENTS

| | | |
|---|---|---|
| JP | 2008-163539 | 7/2008 |
| WO | 2004/074559 | 9/2004 |
| WO | 2006/123879 | 11/2006 |

* cited by examiner

NANOFIBER SPINNING METHOD AND DEVICE

BACKGROUND OF THE INVENTION

1. Technical Field

The present invention relates to a nanofiber spinning method and device for producing nanofibers made of polymeric substances and forming the produced nanofibers into yarn.

2. Description of the Related Art

Conventionally, electrospinning (also referred to as electric charge induced spinning) is known as a method for producing nanofibers made of polymeric substances and having a diameter in submicron order.

In the conventional electrospinning method, a polymer solution is supplied to a needle nozzle to which a high voltage is applied, so that the polymer solution extruded as filaments through the needle nozzle is electrically charged. As a solvent of the polymer solution which is electrically charged evaporates, a distance between these electric charges decreases and Coulomb force acting thereon increases. When the increased Coulomb force exceeds the surface tension of the filamentous polymer solution, the filamentous polymer solution undergoes a phenomenon in which the filamentous polymer solution is explosively stretched. This phenomenon is referred to as an electrostatic explosion. The electrostatic explosion repeats itself as primary, secondary, and sometimes tertiary explosions and so on, and accordingly, nanofibers made of polymers and having a submicron diameter are obtained.

However, since, in the conventional electrospinning method, only a small amount of nanofibers can be produced from the tip of a single nozzle, high productivity cannot be obtained. Consequently, as a method for producing a large amount of nanofibers, a method utilizing a plurality of nozzles has been proposed (For example, see patent reference 1).

According to patent reference 1, polymer solution stored in a barrel is supplied, by a pump, to a plurality of needle nozzles which are electrically charged, and is ejected through the nozzles, thereby producing a large amount of nanofibers. The large amount of nanofibers thus produced, are collected by a collector which is charged to a polarity opposite to those of the nozzles, and transported while being deposited. In such a manner, a highly porous polymer web in which porosity is extremely high, and which is made by nanofibers depositing in a three-dimensional network structure, are produced. Further, the patent reference 1 discloses that such technique improves nanofiber production from a conventional experimental level to a practical level.

Further, conventionally, nanofibers produced by the electrospinning method are formed into a web. Such web is used in various applications, such as an artificial leather, a filter, a diaper, a sanitary pad, an adhesion-inhibiting agent, a wiping cloth, an artificial vessel, and a bone fixation apparatus. However, it is difficult for thus produced nanofiber web to achieve physical properties of 10 MPa or more, which imposes a limitation in a wider range of applications. Further, when forming thus produced nanofibers into a continuous yarn so as to enhance physical properties, there is a problem in that the web has to be cut into a certain length to form short fibers, and the short fibers has to undergo an additional spinning process for forming spun yarns.

Consequently, there is a proposed technique for continuously forming yarn utilizing a nanofiber web produced by the electrospinning method (for example, see patent reference 2). In the patent reference 2, polymer solution is ejected through electrically charged nozzles which are aligned, toward a collector which is charged to a polarity opposite to those of the nozzles. With this, nanofibers are spun on the still surface of water or organic solvent of the collector, and are deposited forming a web. Thus deposited web is pulled by a rotary roller rotating at a constant linear velocity from the position spaced more than 1 cm from one end viewed in the direction of alignment of the nozzles, thereby forming a continuous yarn. Further, the continuous yarn is pressed, stretched, dried and wound so that the continuous yarn which is superior in physical properties can be obtained. The patent reference 2 also discloses that the continuous yarn can also be twisted.

Patent Reference 1: Japanese Unexamined Patent Application Publication No. 2002-201559

Patent Reference 2: Japanese Unexamined Patent Application Publication No. 2006-507428

SUMMARY OF THE INVENTION

1. Problems that Invention is to Solve

However, the technique disclosed in the patent reference 2 has problems in that proper control of size or physical properties of the continuous yarn is difficult, and production of a large amount of continuous yarn is also difficult.

More specifically, in the technique disclosed in the patent reference 2, nanofibers are produced immediately below each nozzle, and are statically deposited at the positions, corresponding to the nozzles above, on the collector. With the spread of the deposition area of the nanofibers, the nanofibers produced from each nozzle intertwine with each other, thereby producing a web with a band like structure. Then, a bunch of nanofibers are pulled from one end of the web, causing a bunch of nanofibers connected to the other end of the web are sequentially pulled, thereby forming the web into a continuous yarn.

Here, depositions of the nanofibers spun from each nozzle are static and almost equal. However, the effects of pulling tend to concentrate in the deposition area of the nanofibers which are closer to the pulling side. Thus, a difference in the amount of nanofibers pulled may be generated between the deposition area of the nanofibers closer to the pulling side and that of the nanofibers further from the pulling side. In such a case, the difference of the amount of the nanofibers pulled results in the difference of the deposition amount of the nanofibers. This results in such a state that the nanofibers are pulled with different deposition amount.

Therefore, such a problem occurs that proper control of size or physical properties of the continuous yarn is difficult and unstable. Further, it is necessary to suppress the speed of pulling of the nanofibers in order to allow the effects of pulling to act evenly on the deposition area of the nanofibers which are further from the pulling side as well. As a result, production of a large amount of continuous yarn also becomes difficult.

The present invention is conceived to solve such conventional problems. The object of the present invention is to provide a nanofiber spinning method and device which are capable of producing high strength and uniform yarn made of nanofibers which are produced by an electrospinning method, with high productivity and at a low cost.

2. Means to Solve the Problems

A nanofiber spinning method according to an aspect of the present invention, includes: producing nanofibers by extruding polymer solution through small holes and charging the polymer solution, and by allowing the polymer solution to be stretched by an electrostatic explosion, the polymer solution being prepared by dissolving a polymeric substance in a solvent; twisting the nanofibers which have been produced, by causing a collecting electrode unit to attract the nanofibers and simultaneously rotate the nanofibers and to gather the nanofibers, the collecting electrode unit having an electric potential different from an electric potential of the polymer solution which has been charged; and collecting the nanofibers which have been twisted, by winding.

In order to charge the polymer solution extruded through the small holes, a high electric potential difference is applied between the members forming the small holes and the collecting electrode unit, and an electric field is applied therebetween. More particularly, examples of possible method include a method in which a positive or negative high voltage is applied to the members forming the small holes, and a high voltage with an opposite polarity is applied to the collecting electrode unit or the collecting electrode unit is grounded, and a method in which a positive or negative high voltage is applied to the collecting electrode unit, and the members forming the small holes are grounded.

With the above structure, nanofibers made of polymeric substances are produced by the electrospinning method, and the produced nanofibers are attracted to the collecting electrode unit while being rotated, and gathered by the collecting electrode unit, thereby twisting the produced nanofibers. With this, a high strength and uniform yarn is formed, and the formed yarn is collected by winding. As a result, it is possible to produce a high strength and uniform yarn made of nanofibers with high productivity and at a low cost.

Further, it may be that, in the twisting, the nanofibers, which have been produced and are travelling toward the collecting electrode unit, are rotated about a central axis along a direction of travel of the nanofibers, in a direction opposite to a direction of rotation of the nanofibers caused by the collecting electrode unit.

With this, the nanofibers, which have been produced and are travelling, are rotated in the direction opposite to the direction of twist of the nanofibers, thereby providing stronger twisting. This allows production of higher strength yarn with high productivity. As a method for rotating the produced nanofibers in such a manner, the following method is preferable for effectively producing a large amount of nanofibers. More particularly, filamentous polymer solution is extruded through small holes of the conductive rotary container, and the polymer solution is stretched by centrifugal force and also stretched by electrostatic explosion, thereby producing nanofibers. When the nanofibers are being produced, a voltage with a polarity identical to that of the charged polymer solution is applied to a reflecting electrode provided at one side of the central axial direction of the rotary container. This allows the nanofibers to travel toward the other side of the central axial direction of the rotary container while rotating. Further, it may be that polymer solution is extruded through small holes and nanofibers are produced while travelling in a single direction, and at the same time, the small holes through which the polymer solution is extruded are rotated about a central axis along the direction of travel of the nanofibers.

Further, it may be that the collecting electrode unit includes a collecting electrode having a center provided with a through-hole through which the nanofibers pass, and in the twisting, the collecting electrode is rotated about a central axis of the collecting electrode, so that the nanofibers which have been produced are rotated and twisted.

With this, by rotating the collecting electrode in such a state where the produced nanofibers are being attracted to the collecting electrode, the nanofibers are rotated while travelling toward the collecting electrode. As a result, the nanofibers can be reliably twisted.

Further, it may be that the collecting electrode unit includes a collecting electrode around a through-hole which is provided at a center of the collecting electrode unit and through which the nanofibers pass, and in the twisting, the collecting electrode forms a rotating electric field, so that the nanofibers which have been produced are rotated and twisted.

With this, the produced nanofibers travel while being rotated by the rotating electric field generated by the collecting electrode, and simultaneously are attracted to the collecting electrode. As a result, the nanofibers can be reliably twisted.

Further, it may be that at least in an initial period of spinning, a core yarn is fed through a central axis of rotation of the nanofibers which are rotated and gathered in the twisting, and the core yarn is wound together with the nanofibers in the collecting.

With this, by nanofibers tangling around the core yarn, providing a reliable spinning is possible even in the initial period of spinning when the effects of spinning are particularly unstable.

Further, a nanofiber spinning device according to an aspect of the present invention includes: a nanofiber producing unit which (i) produces nanofibers by extruding, through small holes, polymer solution prepared by dissolving a polymeric substance in a solvent and charging the polymer solution, and by allowing the polymer solution to be stretched by an electrostatic explosion and (ii) to allow the nanofibers to travel in a single direction; a collecting electrode unit which twists the nanofibers which have been produced by attracting the nanofibers and simultaneously rotating the nanofibers, and to gather the nanofibers, the collecting electrode unit having an electric potential different from an electric potential of the polymer solution which have been charged; and a collecting unit which collects, by winding, the nanofibers passed through a center of the collecting electrode unit in a state where the nanofibers are being twisted and gathered.

With this structure, nanofibers produced by the nanofiber producing unit are attracted to the collecting electrode unit while being rotated, and then twisted and gathered, thereby forming yarn. Since the formed yarn is collected by the collecting unit, a high strength and uniform yarn made of nanofibers can be produced with high productivity and at a low cost.

Further, it may be that the nanofiber producing unit rotates the nanofibers which have been produced and are travelling toward the collecting electrode unit about a central axis along a direction of travel of the nanofibers, in a direction opposite to a direction of rotation of the nanofibers caused by the collecting electrode unit.

With this, the nanofibers, which have been produced and are travelling, are rotated in a direction opposite to the direction of twist of the nanofibers, thereby providing stronger twisting. This allows production of higher strength yarn with high productivity. For the nanofiber producing unit, the following method is preferable for effectively producing a large amount of nanofibers. More particularly, filamentous polymer solution is extruded through the small holes of the conductive rotary container, and the polymer solution is stretched by the centrifugal force and also stretched by the electrostatic explosion, thereby producing nanofibers. When the nanofibers are being produced, the produced nanofibers travel toward the other side of the central axial direction of the rotary container while being rotated by a reflecting electrode which is provided at one side of the central axial direction of the rotary container and to which a voltage with a polarity identical to that of the charged polymer solution is applied. Further, it may be that polymer solution is extruded through the small holes and nanofibers are produced while travelling in a single direction, and at the same time, the small holes are rotated about a central axis along the direction of travel of the nanofibers.

Further, it may be that the collecting electrode unit includes a collecting electrode and a rotating unit, the collecting electrode having a center provided with a through-hole through which the nanofibers pass, the rotating unit rotating the collecting electrode to about a central axis of the collecting electrode.

With this, nanofibers are rotated while travelling toward the collecting electrode, thereby reliably twisting the nanofibers.

Further, it may be that the collecting electrode unit includes collecting electrodes around a through-hole which is provided at a center of the collecting electrode unit and through which the nanofibers pass, and the collecting electrode unit forms a rotating electric field by controlling a phase of an alternating voltage and applying the alternating voltage to each of the collecting electrodes, or by making each of the collecting electrodes to have a phase different to each other and reciprocating the collecting electrodes.

With this, the produced nanofibers travel while being rotated by the rotating electric field generated by the collecting electrode unit and simultaneously are attracted to the collecting electrode, thereby reliably twisting the nanofibers.

Further, it may be that the nanofiber spinning device further includes a core yarn feeding unit which feeds a core yarn through a central axis of rotation of the nanofibers which are rotated and gathered, such that the core yarn is wound by the collecting unit.

With this, by winding the core yarn through the central axis of rotation of the nanofibers, the nanofibers tangle around the core yarn, and a reliable and stable spinning can be obtained. Furthermore, it is effective in the initial period of spinning when the effects of spinning are particularly unstable.

3. Effects of the Invention

According to the nanofiber spinning method and device of the present invention, nanofibers made of polymeric substances are produced by an electrospinning method, and the produced nanofibers are attracted to the collecting electrode unit while being rotated, and are gathered by the collecting electrode unit, thereby twisting the nanofibers. As a result, a uniform and high strength yarn can be formed. By winding the formed yarn, a high strength yarn made of nanofibers can be produced with high productivity and at a low cost.

NUMERICAL REFERENCES

Figure 1:
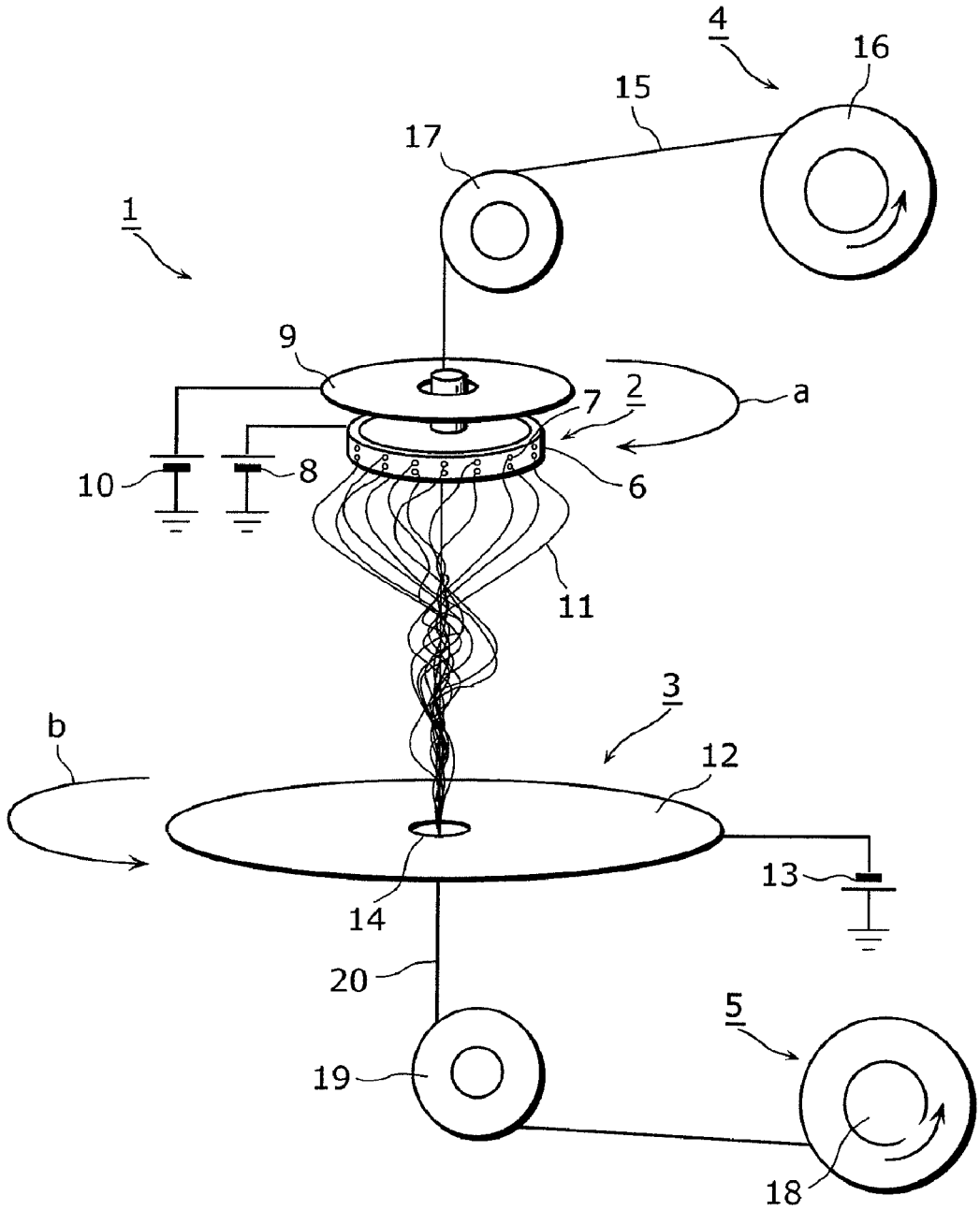
FIG. 1 is a perspective view of an overall schematic structure of a nanofiber spinning device according to a first embodiment of the present invention.

1 Nanofiber spinning device
2 Nanofiber producing unit
3 Collecting electrode unit
4 Core yarn feeding unit
5 Collecting unit
6 Cylindrical container (rotary container)
7 Small hole
8, 10, 13 High voltage generating unit
11 Nanofiber
12 Collecting electrode
14 Through-hole
15 Core yarn
20 Yarn
23 Collecting electrode

30, 40 Rotation drive unit
31 Polymer solution
32 Polymer solution supplying unit
45 Rotating electric field generating unit
46*a* to 46*d* Divided electrodes
47*a* to 47*d* AC sources
49 Inclined collecting electrode
50 Nanofiber producing head
60 Blowing unit
122 Shaft
122*a* Enlarged head portion
122*b* Through-hole

DETAILED DESCRIPTION OF THE INVENTION

Hereinafter, each embodiment of a nanofiber spinning method and device according to the present invention will be described with reference to FIG. 1 to FIG. 19.

(First Embodiment)

Firstly, first embodiment of a nanofiber spinning device according to the present invention will be described with reference to FIG. 1 to FIG. 4.

FIG. 1 is a perspective view of an overall schematic structure of a nanofiber spinning device 1 according to the first embodiment of the present invention.

The nanofiber spinning device 1 is a device which produces nanofibers and rotates the produced nanofibers for spinning. As shown in FIG. 1, the nanofiber spinning device 1 includes a nanofiber producing unit 2, a collecting electrode unit 3, a core yarn feeding unit 4, and a collecting unit 5.

The nanofiber producing unit 2 includes a cylindrical container 6, a first high voltage generating unit 8, a reflecting electrode 9, and a second high voltage generating unit 10.

The cylindrical container 6 is a rotary container which is pivotally supported about its vertical central axis. The cylindrical container 6 has an outer circumferential surface formed with small holes 7. The small holes 7 each have a diameter of approximately 0.02 to 2 mm and are arranged at an interval of a few mm. The cylindrical container 6 is driven to rotate, by a rotation drive unit (not shown), in a direction indicated by the arrow a. Further, polymer solution is supplied into the cylindrical container 6 by a polymer solution supplying unit (not shown).

The first high voltage generating unit 8 applies, to the cylindrical container 6, a high voltage of 1 kV to 200 kV, preferably 10 kV to 100 kV.

The reflecting electrode 9 is an electrode provided above the cylindrical container 6.

The second high voltage generating unit 10 applies, to the reflecting electrode 9, a high voltage with a polarity identical to that of the cylindrical container 6.

As described, the nanofiber producing unit 2 produces nanofibers 11 by allowing polymer solution extruded through the small holes 7 of the cylindrical container 6 to be stretched by centrifugal force and electrostatic explosions. The produced nanofibers 11 are caused to travel downward from the cylindrical container 6 while being rotated by the reflecting electrode 9.

Here, as polymer solution, it is preferable to use solution in which polymeric substances, such as various kinds of synthetic resin materials, nucleic acid and biological polymer like protein, are dissolved in solvent (polymeric substances in the present invention are not limited to general polymeric substances having a molecular weight of 10000 or more, but also include quasi-polymeric substances having a molecular weight of 1000 to 10000). Further, the polymeric substances are not limited to elementary substances, but may be mixture of various kinds of polymeric substances.

More specifically, examples of the polymeric substances include polypropylene, polyethylene, polystyrene, polyethylene oxide, polyethylene terephthalate, polybutylene terephthalate, polyethylene naphtha late, poly-m-phenylene terephthalate, poly-p-phenylene isophthalate, polyvinylidene fluoride, polyvinylidene fluoride-hexafluoropropylene copolymer, polyvinyl chloride, polyvinylidene chloride-acrylate copolymer, polyacrylonitrile, polyacrylonitrile-methacrylate copolymer, polycarbonate, polyarylate, polyester carbonate, nylon, aramid, polycaprolactone, polylactic acid, polyglycolic acid, collagen, polyhydroxybutyric acid, polyvinyl acetate, and polypeptide. Although at least one type selected from the above is used, the present invention should not be limited thereto.

Further, examples of solvents that can be used include methanol, ethanol, 1-propanol, 2-propanol, hexafluoroisopropanol, tetraethylene glycol, triethylene glycol, dibenzyl alcohol, 1,3-dioxolane, 1,4-dioxane, methyl ethyl ketone, methyl isobutyl ketone, methyl-n-hexyl ketone, methyl-n-propyl ketone, diisopropyl ketone, diisobutyl ketone, acetone, hexafluoroacetone, phenol, formic acid, methyl formate, ethyl formate, propyl formate, methyl benzoate, ethyl benzoate, propyl benzoate, methyl acetate, ethyl acetate, propyl acetate, dimethyl phthalate, diethyl phthalate, dipropyl phthalate, methyl chloride, ethyl chloride, methylene chloride, chloroform, o-chlorotoluene, p-chlorotoluene, carbon tetrachloride, 1,1-dichloroethane, 1,2-dichloroethane, trichloroethane, dichloropropane, dibromoethane, dibromopropane, methyl bromide, ethyl bromide, propyl bromide, acetic acid, benzene, toluene, hexane, cyclohexane, cyclohexanone, cyclopentane, o-xylene, p-xylene, m-xylene, acetonitrile, tetrahydrofuran, N,N-dimethylformamide, pyridine, and water. Although at least one type selected from the above is used, the present invention should not be limited thereto.

In addition, some additive agent such as aggregate or plasticizing agent may be added to the polymer solution. Examples of additive agent include oxides, carbides, nitrides, borides, silicides, fluorides, and sulfides. However, in terms of thermal resistance, workability, and the like, oxides are preferable. Examples of oxides include $Al_2O_3$, $SiO_2$, $TiO_2$, $Li_2O$, $Na_2O$, MgO, CaO, SrO, BaO, $B_2O_3$, $P_2O_5$, $SnO_2$, $ZrO_2$, $K_2O$, $Cs_2O$, ZnO, $Sb_2O_3$, $As_2O_3$, $CeO_2$, $V_2O_5$, $Cr_2O_3$, MnO, $Fe_2O_3$, CoO, NiO, $Y_2O_3$, $Lu_2O_3$, $Yb_2O_3$, $HfO_2$, and $Nb_2O_5$. Note that the above addictive agents are just examples, and the present invention should not be limited thereto.

Although the mixing ratio of solvent and polymeric substance depends on a type of the solvent and the polymeric substance to be mixed, the desirable ratio of the solvent amount is in a range from about 60% to 98%.

The collecting electrode unit 3 is made to have an electric potential different from that of the charged polymer solution, and twists and gathers the produced nanofibers 11 by attracting and simultaneously rotating the nanofibers 11. The collecting electrode unit 3 includes a collecting electrode 12 and a third high voltage generating unit 13.

The collecting electrode 12 is a disc-shaped electrode which is provided pivotally and coaxially below the cylindrical container 6 with a certain distance. The collecting electrode 12 is driven to rotate, by the rotation drive unit (not shown), in a direction indicated by the arrow b which is opposite to the direction indicated by the arrow a. Further, the collecting electrode 12 has a center provided with a through-hole 14 through which the gathered nanofibers 11 pass.

The third high voltage generating unit 13 applies, to the collecting electrode 12, a high voltage with a polarity opposite to those of the cylindrical container 6 and the reflecting electrode 9.

The collecting electrode 12 only needs to have an electric potential difference with respect to the cylindrical container 6 and the reflecting electrode 9; and thus, the collecting electrode 12 may simply be grounded. However, it is more effective that the third high voltage generating unit 13 applies voltage with an opposite polarity to the collecting electrode 12. Alternatively, it may be that the cylindrical container 6 has a ground potential, and the third high voltage generating unit 13 applies a positive or negative high voltage to the collecting electrode 12, such that an electric field is generated between the cylindrical container 6 and the collecting electrode 12.

The core yarn feeding unit 4 is provided above the nanofiber producing unit 2, and includes a core yarn feeding roll 16 and a guide roller 17.

The core yarn feeding roll 16 is a feeding roll around which core yarn 15 is wound such that the core yarn 15 can be unwound.

The guide roller 17 is a guide roller which guides the unwound core yarn 15 such that the unwound core yarn 15 can be fed from a position immediately above the central axis of the cylindrical container 6 downward.

The core yarn feeding unit 4 only needs to feed the core yarn 15, at least in the initial period of spinning, only for a certain period till the effects of gathering the nanofibers 11 and forming yarn 20 become stable.

The collecting unit 5 is provided below the collecting electrode unit 3, and includes a yarn winding roll 18 and a guide roller 19.

The yarn winding roll 18 is a winding roll which winds the yarn 20 formed by the nanofibers 11 being gathered.

The guide roller 19 is a guide roller which is positioned coaxially with the central axis of the collecting electrode unit 3, and guides the yarn 20 which is formed by the nanofibers 11 being twisted and gathered, such that the yarn 20 passes through the through-hole 14 downward.

With the above structure, polymer solution is supplied into the cylindrical container 6 of the nanofiber producing unit 2, and at the same time, the cylindrical container 6 is driven to rotate at a high speed. Then, the centrifugal force acts on the polymer solution contained in the cylindrical container 6, and the polymer solution is extruded as filaments through each small hole 7. At the same time, the polymer solution is stretched under the influence of the centrifugal force to become thin polymeric filaments. These polymeric filaments are then subjected to an electric field, and are electrically charged. Further, when the solvent in the polymeric filaments evaporates, the diameter of the polymeric filaments decreases and the electric charge residing thereon becomes concentrated. When Coulomb force exceeds the surface tension of the polymer solution, a primary electrostatic explosion takes place, and the polymeric filament is explosively stretched. Then, as the solvent further evaporates, a secondary electrostatic explosion takes place, and the polymeric filament is further stretched explosively. Depending on the condition, a tertiary electrostatic explosion and so on may take place. Consequently, nanofibers 11 which have submicron diameters and are made of polymeric substances are effectively produced.

The produced nanofibers 11 are directed downward from the cylindrical container 6 by the reflecting electrode 9 provided above the cylindrical container 6, and travel while being rotated about the central axis of the cylindrical container 6 by high speed rotation of the cylindrical container 6. Further, the nanofibers 11, which travel downward while rotating, are strongly attracted to the collecting electrode 12 provided below. Further, the collecting electrode 12 rotates in a direction opposite to the direction of rotation of the nanofibers 11. This allows the nanofibers 11 which travel while rotating to be more strongly twisted, gathered, and spun, thereby effectively forming the high strength yarn 20. The formed yarn 20 passes through the through-hole 14 provided at the center of the collecting electrode 12, and is collected by the collecting unit 5 through winding by the yarn winding roll 18 via the guide roller 19.

Further, the effects of twisting, gathering and spinning of the nanofibers 11 which travel while rotating, may be unstable at least when spinning starts and in the initial period of spinning. Therefore, before starting spinning, the core yarn 15 is unwound from the core yarn feeding unit 4, the core yarn 15 passes through the central axis of the nanofiber generating unit 2 and the collecting electrode unit 3, and the tip of the core yarn 15 is wound by the yarn winding roll 18 of the collecting unit 5. By operating the nanofiber producing unit 2 and the collecting electrode unit 3 in such a state, the nanofibers 11 are produced, travel downward while rotating, and start to be gathered as they become closer to the collecting electrode unit 3. At this time, operating the collecting unit 5 allows the nanofibers 11 which is gathered while traveling to tangle around the core yarn 15 and to be gathered at once. Thereby, the nanofibers 11 are reliably spun around the yarn 15, and collected.

Once winding of the yarn 20 by the collecting unit 5 becomes stable, even without feeding the core yarn 15, the nanofibers 11 gathered earlier and being spun are tangled around by successive nanofibers 11, thereby the nanofibers 11 are spun. Thus, the nanofibers 11 being spun serve as the core yarn 15, which allows spinning without feeding of the core yarn 15 by the core yarn feeding unit 4. Note that in the case of forming yarn having the core yarn at the center, of course, the core yarn 15 may be continuously fed.

Here, another example of structure of the nanofiber producing unit 2 is described.

In the example shown in FIG. 1, as a rotary container, the cylindrical container 6 provided with small holes 7 on its circumferential surface is used; however, the cylindrical container 6 may be structured as described below.

Figure 2:
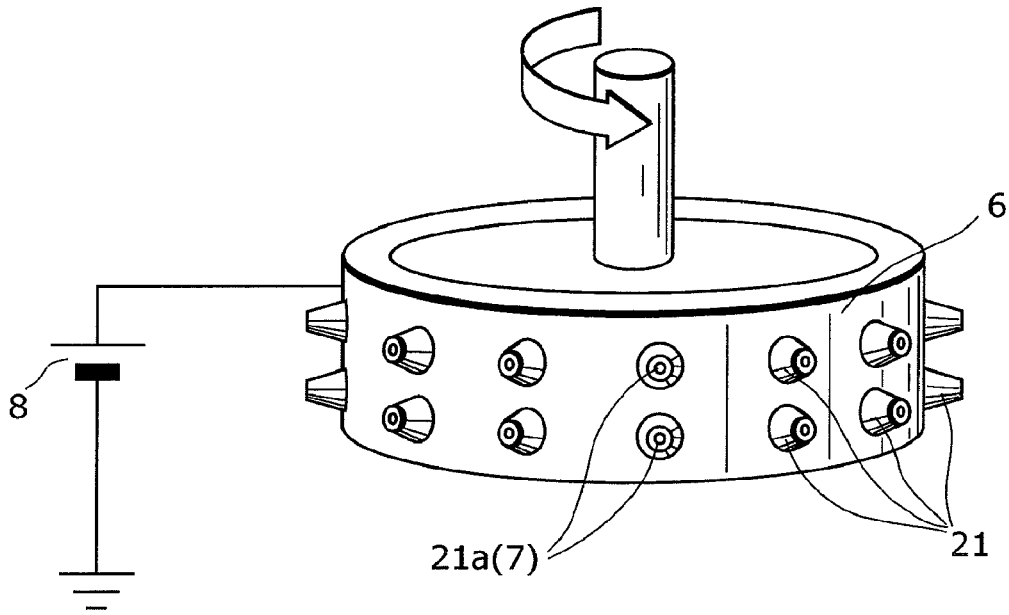
FIG. 2 is a perspective view of another example of structure of a cylindrical container of a nanofiber producing unit according to the first embodiment.

FIG. 2 is a perspective view of another example of structure of the cylindrical container 6 of the nanofiber producing unit 2 according to the first embodiment.

Figure 3A:
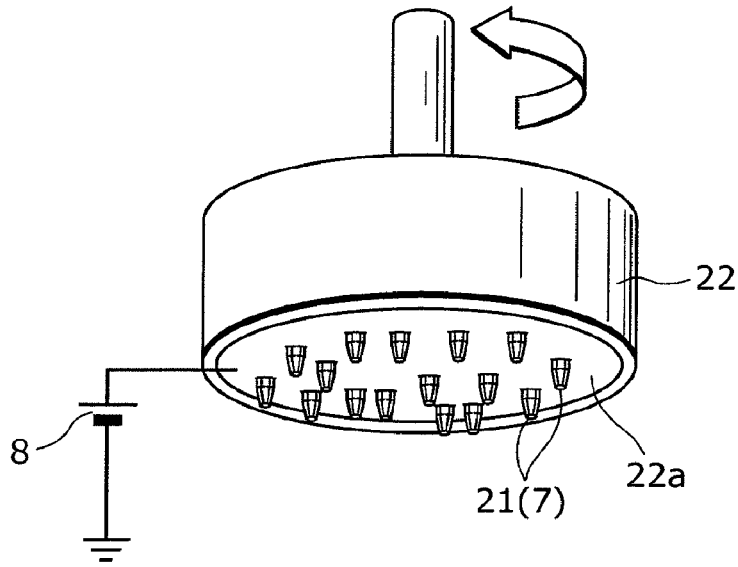
FIG. 3A is a perspective view of a further example of structure of the cylindrical container of the nanofiber producing unit according to the first embodiment.
Figure 3B:
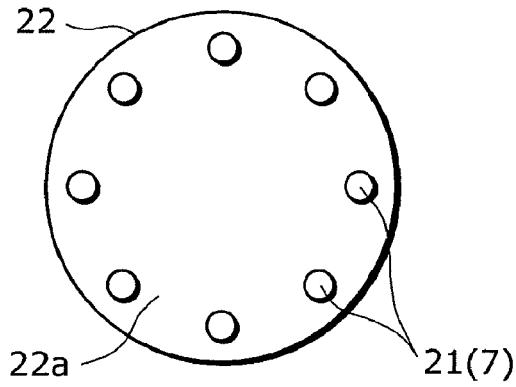
FIG. 3B is a bottom view of an example of arrangement of each nozzle according to the above further example of structure.
Figure 3C:
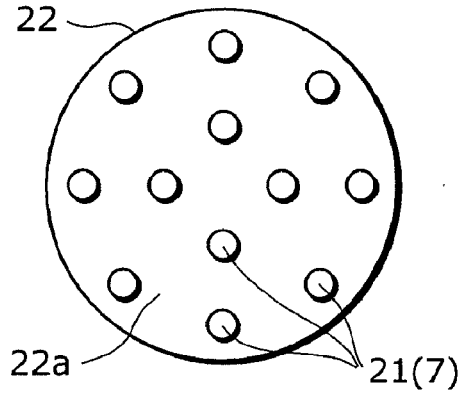
FIG. 3C is a bottom view of another example of arrangement of each nozzle according to the above further example of structure.

Further, FIG. 3A is a perspective view of a further example of structure of the cylindrical container 6 of the nanofiber producing unit 2 according to the first embodiment. FIG. 3B and FIG. 3C are bottom views of examples of arrangement of each nozzle according to the above further example of structure.

As shown in FIG. 2, the cylindrical container 6 includes nozzles 21 provided on its circumferential surface at a suitable interval. Each nozzle 21 has a nozzle hole 21*a* which serves as the small hole 7.

Further, the cylindrical container 6 has a small hole (not shown) for allowing the core yarn 15 to pass through at the central axis. The core yarn 15 is fed to the nanofiber producing unit 2 and the collecting electrode unit 3 via the guide roller 17 of the core yarn feeding unit 4, and is collected by thy collecting unit 5 via the guide roller 19.

Further, as shown in FIG. 3A, the cylindrical container 22 is rotatable about the vertical central axis, and has nozzles 21 or small holes 7 on the end surface 22*a* at the bottom. Further, in this case, the nozzles 21 or the small holes 7 may be, as shown in FIG. 3B, circumferentially arranged at a predetermined interval on the outer circumference of the end surface 22*a*, or may be, as shown in FIG. 3C, dispersed at a predetermined interval on the entire surface of the end surface 22*a*.

Further, the cylindrical container 22 shown in FIGS. 3A, 3B and 3C, also has a small hole (not shown) for allowing the core yarn 15 to pass through at the central axis, as in the cylindrical container 6 shown in FIGS. 1 and 2.

Further, in the example shown in FIG. 1, the disc-shaped collecting electrode 12 is used as the collecting electrode unit 3; however, the collecting electrode unit 3 may be structured as described below.

Figure 4A:
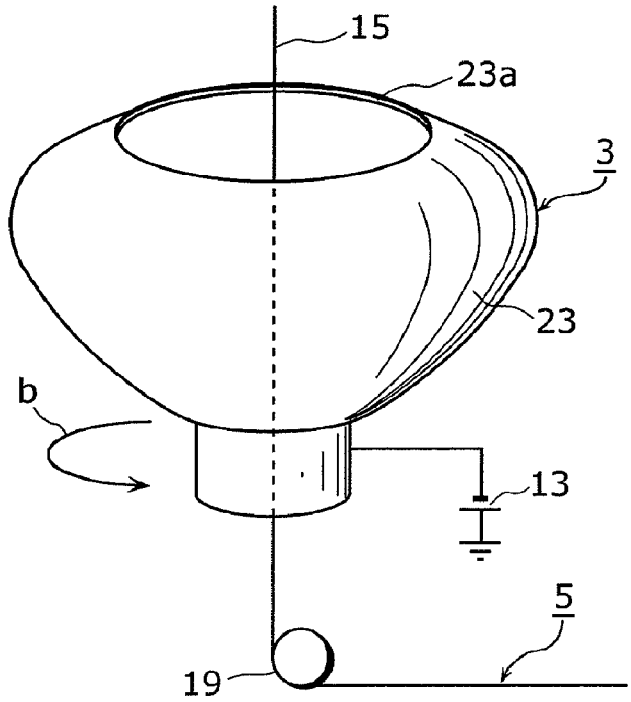
FIG. 4A is a perspective view of another example of structure of a collecting electrode unit according to the first embodiment.
Figure 4B:
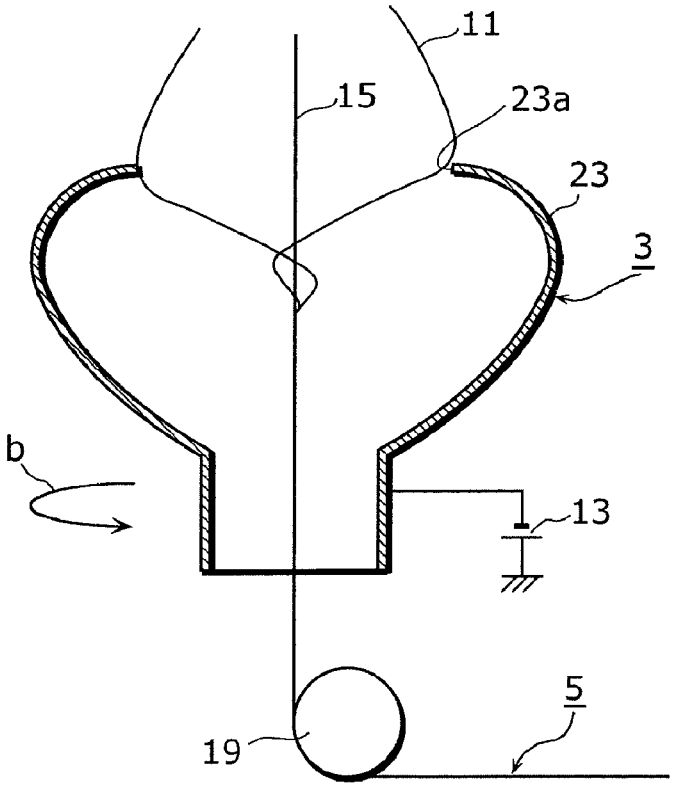
FIG. 4B is a cross-sectional view of an operating state of the collecting electrode unit according to the above another example of structure.

FIG. 4A is a perspective view of another example of structure of the collecting electrode unit 3 according to the first embodiment, and FIG. 4B is a cross-sectional view showing an operating state of the collecting electrode unit according to the another example of structure.

As shown in FIG. 4A, the collecting electrode unit 3 includes a collecting electrode 23 which is a vase-shaped electrode. The vase-shaped collecting electrode 23 is substantially cone shaped such that it gradually narrows from the top toward the bottom. The vase-shaped collecting electrode 23 has a small-diameter cylinder at the bottom, and has a top portion 23*a* narrowed to be small in diameter.

As shown in FIG. 4B, by providing the vase-shaped collecting electrode 23, the nanofibers 11 which travel while rotating first hits the edge of the top portion 23*a* of the rotating collecting electrode 23, which causes the nanofibers 11 to rotate vigorously. With this, effects of reliable tangle of the nanofibers 11 around the core yarn 15 is accelerated, thereby providing smoother and more stable forming of the yarn 20.

Figure 5A:
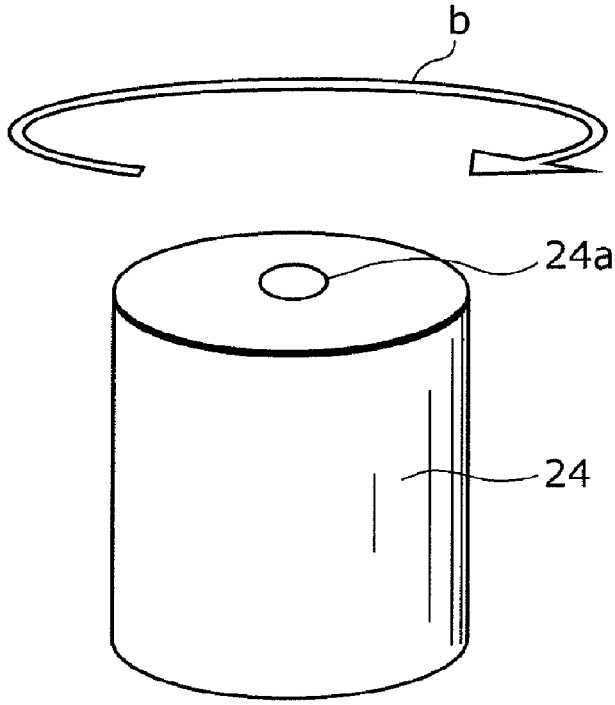
FIG. 5A is a perspective view of a further example of structure of the collecting electrode unit according to the first embodiment.
Figure 5B:
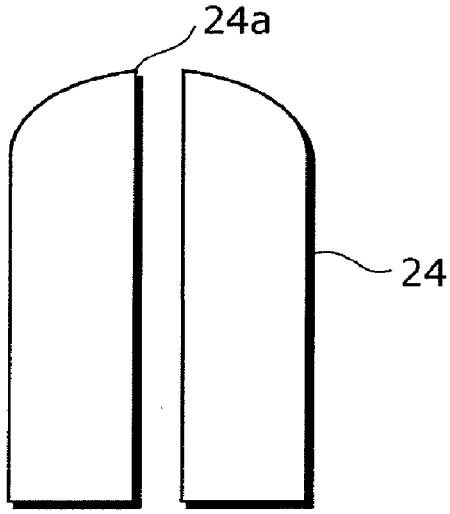
FIG. 5B is a cross-sectional view of the collecting electrode unit according to the above further example of structure.

FIG. 5A is a perspective view of a further example of structure of the collecting electrode unit 3 according to the first embodiment, and FIG. 5B is a cross-sectional view thereof.

As shown in FIG. 5A and FIG. 5B, the collecting electrode unit 3 includes a collecting electrode 24 which is a cylindrical electrode.

The cylindrical collecting electrode 24 has a through-hole 24*a*. By providing the cylindrical collecting electrode 24, the same effects obtained by the vase-shaped collecting electrode 23 shown in FIG. 4A and FIG. 4B can be obtained. More specifically, the nanofibers 11 which travel while rotating first hit the edge of the top end of the through-hole 24*a* of the collecting electrode 24 which rotates in a direction indicated by the arrow b, thereby causing the nanofibers 11 to rotate vigorously. With this, the effects of reliable tangle of the nanofibers 11 around the core yarn 15 is accelerated, thereby providing smoother and more stable forming of the yarn 20.

As described, according to the other structure examples of the present embodiment shown in FIG. 2 to FIG. 5B, the nanofiber producing unit 2 produces the nanofibers 11 made of polymeric substances from the cylindrical container 6 or the cylindrical container 22 by the electrospinning method. Then the nanofibers 11 are deflected downward by the reflecting electrode 9, thereby allowing the nanofibers 11 to travel downward while rotating. Consequently, the nanofibers 11 are attracted to the collecting electrode 12, the collecting electrode 23, or the collecting electrode 24 which are included in the collecting electrode unit 3 and which rotate in the opposite direction, thereby providing stronger twist and gathering of the nanofibers, and forming uniform and high strength yarn 20. The yarn 20 is collected by the collecting unit 5 through winding, thereby producing high strength and uniform yarn 20 made of nanofibers, with high productivity and at a low cost. Further, at least in the initial period of spinning, the core yarn 15 is fed, by the core yarn feeding unit 4, through the central axis of rotation of the nanofibers 11 which are rotating and gathering, and the core yarn 15 is wound by the collecting unit 5. With this, by nanofibers 11 tangling around the core yarn 15, providing a reliable spinning is possible even in the initial period of spinning when the effects of spinning is particularly unstable.

(Second Embodiment)

Next, second embodiment of a nanofiber spinning device 1 according to the present invention is described with reference to FIG. 6 and FIG. 7. Note that in the following descriptions of embodiments, identical reference numerals are assigned to elements identical to those described in the previous embodiment, and descriptions thereof are omitted. Only differences from the previous embodiment are mainly described.

Figure 6:
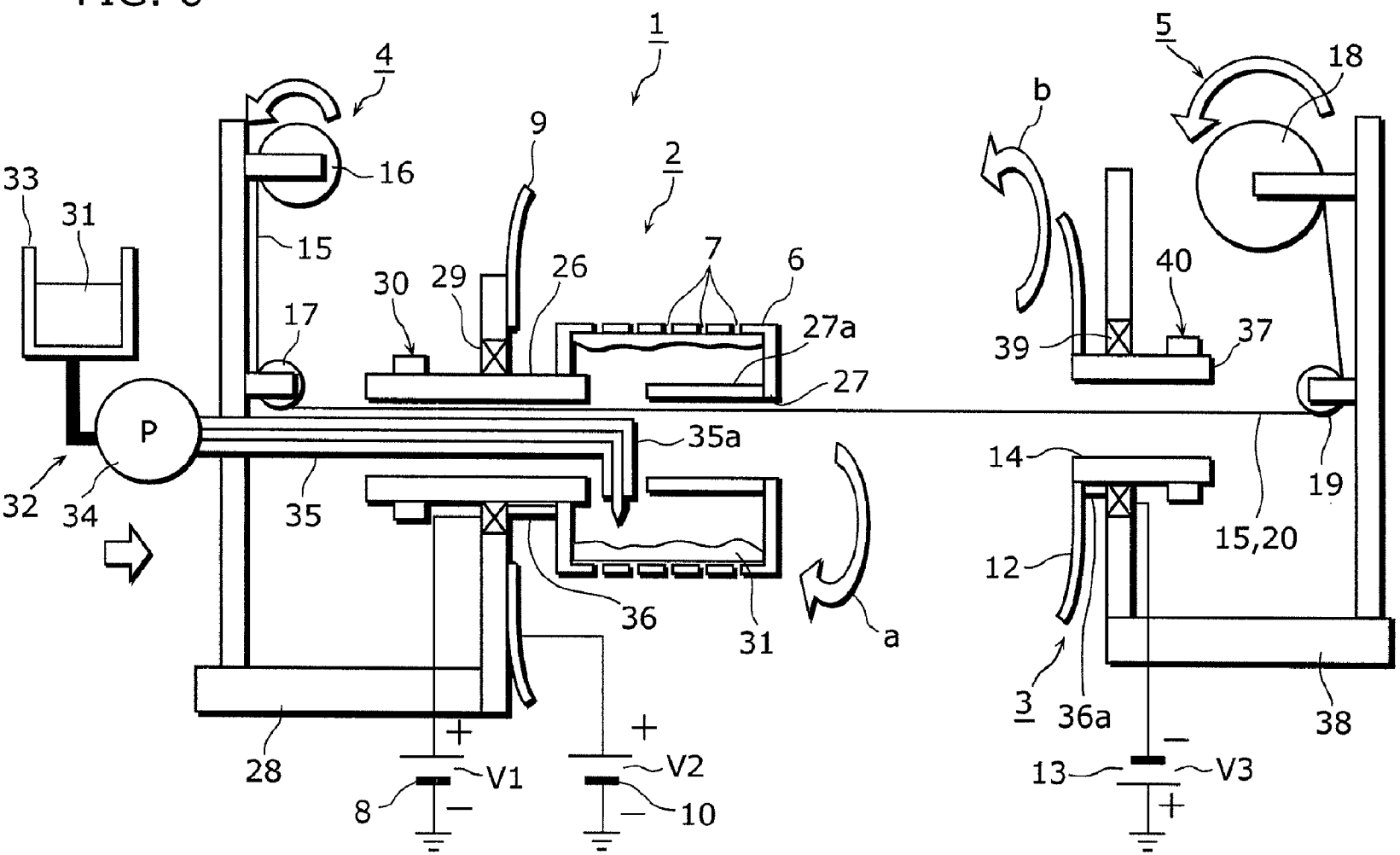
FIG. 6 is a longitudinal elevation view of an overall schematic structure of a nanofiber spinning device according to a second embodiment of the present invention.

FIG. 6 is a longitudinal elevation view of an overall schematic structure of a nanofiber spinning device 1 according to second embodiment of the present invention.

In the first embodiment, an example has been described where a core yarn feeding unit 4, a nanofiber generating unit 2, a collecting electrode unit 3, and a collecting unit 5 are provided in a vertical direction from the top to the bottom in the mentioned order, a cylindrical container 6 and a collecting electrode 12 are rotated about the vertical central axis, and produced nanofibers 11 are directed downward and rotated while travelling. However, in the present embodiment, the core yarn feeding unit 4, the nanofiber producing unit 2, the collecting electrode unit 3, and the collecting unit 5 are provided in a horizontal direction, the cylindrical container 6 and the collecting electrode 12 are rotated about the horizontal central axis, and the produced nanofibers 11 are rotated while traveling in a horizontal direction.

As shown in FIG. 6, the cylindrical container 6 is integrally fixed to a rotary cylinder 26 such that one end of the rotary cylinder 26 penetrates one end of central axis of the cylindrical container 6, and the cylindrical container 6 is pivotally supported by the rotary cylinder 26 such that the cylindrical container 6 rotates about its central axis as indicated by the arrow a. The rotary cylinder 26 is made of materials having high electrical insulating properties. The central axis of the other end of the cylindrical container 6 has an opening 27 with a rising circumferential wall 27*a* projecting inward.

The rotary cylinder 26 is pivotally supported via a bearing 29 by a first support frame 28 made of materials having high electrical insulating properties, and is driven to rotate by a rotation drive unit 30 at a rotation speed of 30 to 10000 rpm. As the rotation drive unit 30, only a driven pulley provided on the outer circumferential surface of the rotary cylinder 26 is shown in the drawing; however, the rotation drive unit 30 include a motor provided to the first support frame 28, a drive pulley provided to an output axis of the motor, and a belt wound between the driven pulley and the drive pulley. As a motor to be used, since a sensor may improperly operate under influence of high voltage noise, a sensorless DC mortor is preferable.

A first high voltage generating unit 8 applies a high voltage to the cylindrical container 6 via the bearing 29 and a conductive member 36.

A polymer solution supplying unit 32 supplies polymer solution 31 into the cylindrical container 6 through the rotary cylinder 26. The polymer solution supplying unit 32 ejects the polymer solution 31 contained in the storage container 33 by a supply pump 34, and supplies the polymer solution 31 into the cylindrical container 6 through a solution supply tube 35. The solution supply tube 35 is provided such that it penetrates the rotary cylinder 26 and has its tip 35*a* reaching the inside the cylindrical container 6.

Further, the first support frame 28 is mounted with a core yarn feeding roll 16 and a guide roller 17 which constitute the core yarn feeding unit 4. The core yarn 15 is fed so as to pass through the central axis of the rotary cylinder 26 and the cylindrical container 6.

The first support frame 28 is also mounted with the reflecting electrode 9, so that a high voltage is applied by a second high voltage generating unit 10.

The collecting electrode 12 has a through-hole 14 which is integrally fixed to one end of a hollow support shaft 37. The hollow support shaft 37 is pivotally supported by a second support frame 38 via a bearing 39.

Further, the collecting electrode 12 is provided coaxially to the cylindrical container 6 with a suitable distance such that the collecting electrode 12 is directly opposite to the other end of the cylindrical container 6.

The hollow support shaft 37 is driven to rotate by the rotation drive unit 40 that is similar to the rotation drive unit 30, and drive the collecting electrode 12 to rotate in a direction indicated by the arrow b which is an opposite to the direction a of rotation of the cylindrical container 6.

A high voltage with a polarity opposite to that of the voltage applied to the cylindrical container 6, is applied to the collecting electrode 12 by a third high voltage generating unit 13 via the bearing 39 and a conductive member 36*a*.

The second support frame 38 is mounted with a yarn winding roll 18 and a guide roller 19 which constitute the collecting unit 5, so that the produced core yarn 15 and the yarn 20 are wound and collected.

Figure 7:
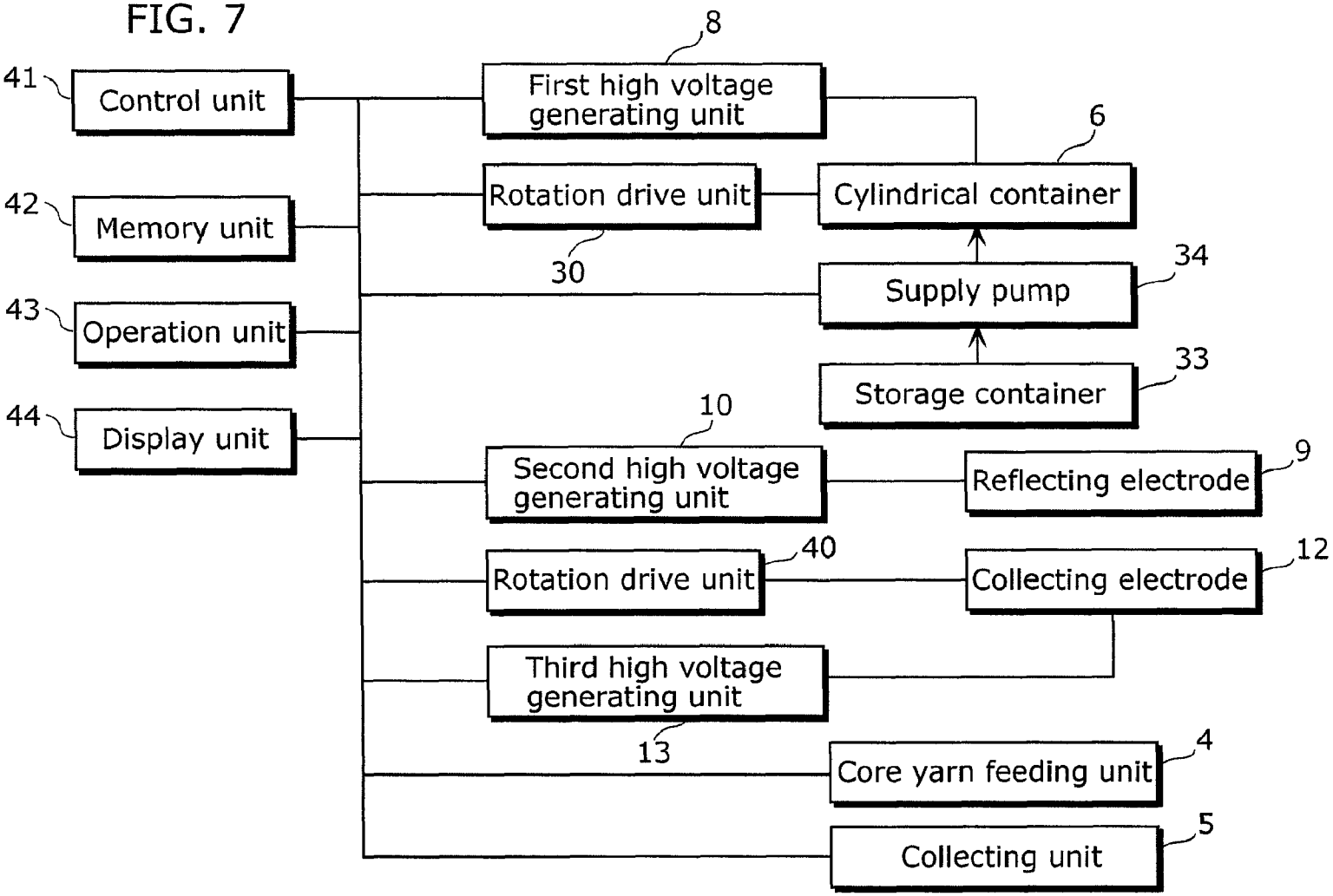
FIG. 7 is a block diagram of a control structure according to the second embodiment.

FIG. 7 is a block diagram of a control structure according to the second embodiment of the present invention.

As shown in FIG. 7, the rotation drive units 30 and 40, the supply pump 34, the first to third high voltage generating units 8, 10, and 13, the core yarn feeding unit 4, and the collecting unit 5 are controlled by a control unit 41. In accordance with an operational instruction from an operation unit 43, the control unit 41 controls operations based on operation programs stored in a memory unit 42 or various kinds of data inputted by the operation unit 43 and stored, and displays the operational status or various kinds of data onto a display unit 44.

The present embodiment basically includes the structure identical to that described in the first embodiment, and differs only in that the direction of rotation of the nanofibers 11 is changed from the vertical direction to the horizontal direction. Thus, by operating each element in a same manner in the present embodiment, the same effects can be obtained.

(Third Embodiment)

Next, third embodiment of a nanofiber spinning device according to the present invention will be described with reference to FIG. 8 to FIG. 12.

Figure 8:
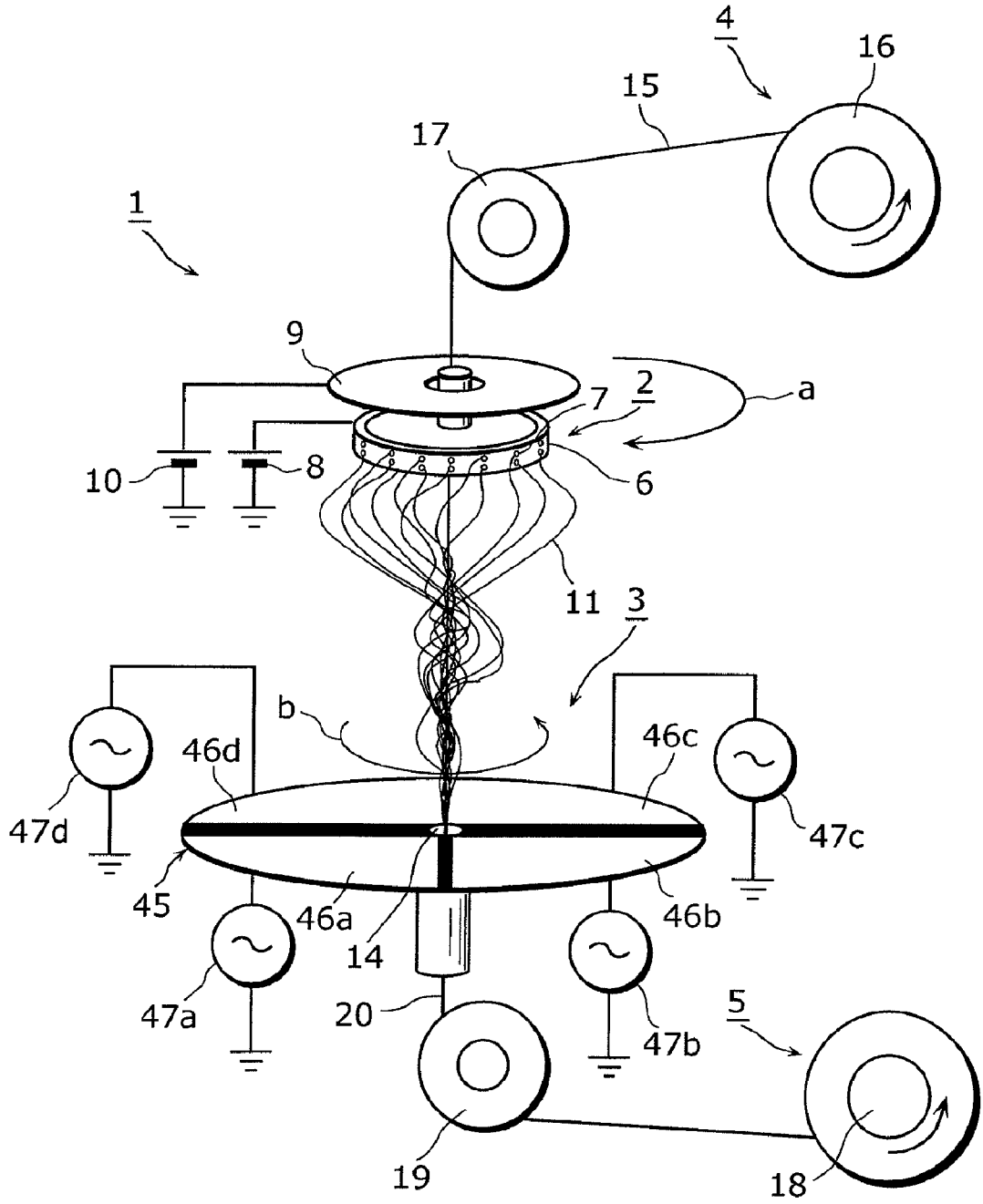
FIG. 8 is a perspective view of an overall schematic structure of a nanofiber spinning device according to a third embodiment of the present invention.

FIG. 8 is a perspective view of an overall schematic structure of a nanofiber spinning device 1 according to the third embodiment of the present invention.

In the first embodiment described above, as an example of the structure of the collecting electrode unit 3, the collecting electrode 12 is rotated; however, in the present embodiment, as shown in FIG. 8, a rotating electric field generating unit 45 is provided for generating, around the through-hole 14, a rotating electric field.

Figure 9:
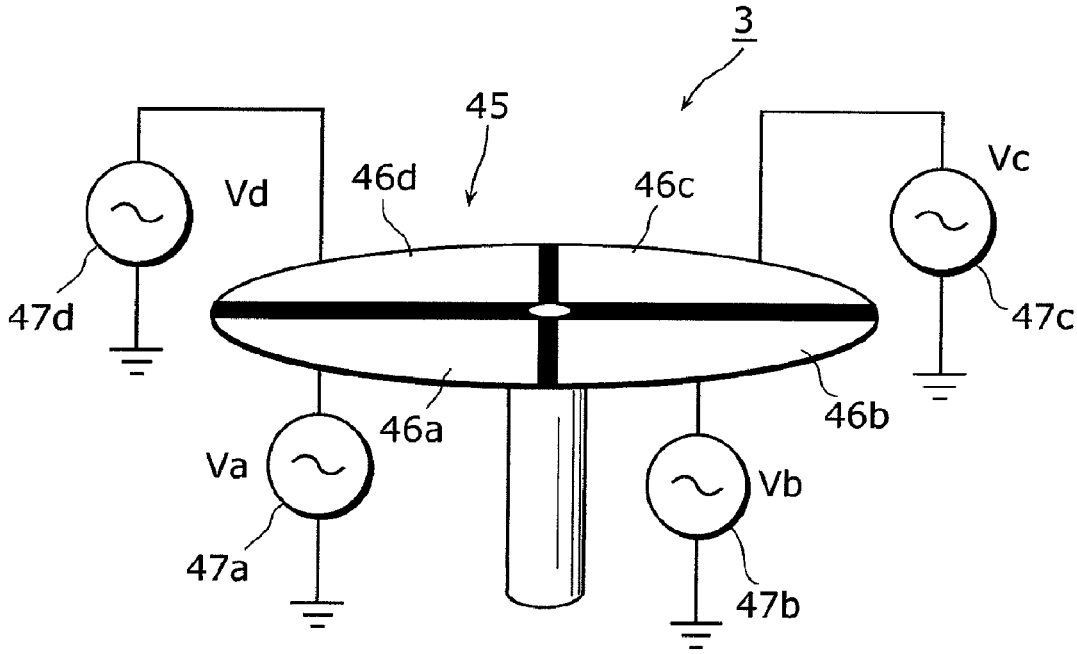
FIG. 9 is a perspective view of a schematic structure of a collecting electrode unit according to the third embodiment.

FIG. 9 is a perspective view of a schematic structure of a collecting electrode unit 3 according to the third embodiment of the present invention.

Figure 10:
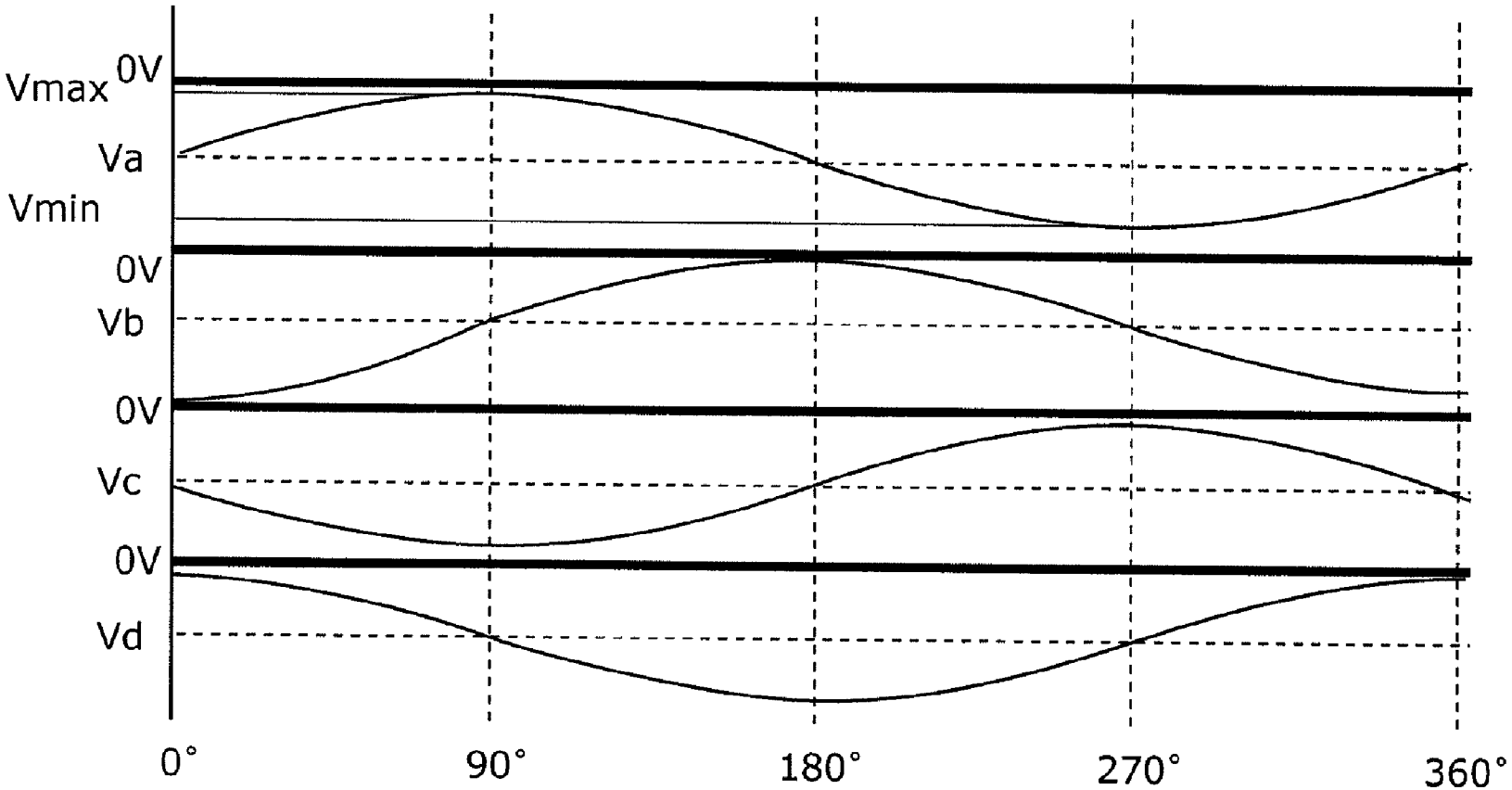
FIG. 10 is a phase diagram showing voltages applied to each divided electrode of the collecting electrode unit.

FIG. 10 is a phase diagram showing voltages applied to each divided electrode in the collecting electrode unit 3.

As shown in FIG. 9, the rotating electric field generating unit 45 circularly includes, around the through-hole 14, divided electrodes 46*a* to 46*d* into which an electrode is circumferentially divided (FIG. 9 shows an example of electrodes divided into four). The divided electrodes 46*a* to 46*b* are electrically isolated to each other. The divided electrodes 46*a* to 46*d* are respectively connected to AC sources 47*a* to 47*d* which output AC voltage in which DC voltage with a polarity opposite to that of the voltage applied to the cylindrical container 6 is superimposed.

Further, as shown in FIG. 10, the AC sources 47*a* to 47*d* have phases of their respective output voltage Va to Vd shifted by 90 degrees.

With the rotating electric field generating unit 45, an electric field, which functions as if it is rotating, can be generated around the through-hole 14 between the nanofiber producing unit 2 and the rotating electric field generating unit 45. The direction of rotation of the electric field is set to the direction b which is opposite to the direction a of rotation of the cylindrical container 6. More specifically, preferable output voltages Va to Vd of the AC sources 47*a* to 47*d* are such that the maximum voltage Vmax is 0 V or less, the minimum voltage Vmin is in the range from −10 kV to −500 kV, and the frequency is in the range from 10 Hz to 500 kHz. Further, output waveform may be sine curve, but is not limited thereto, and also may be triangular wave, square wave, step-like wave, or the like.

According to the structure of the present embodiment, the nanofibers 11 are produced by the nanofiber producing unit 2, and travels downward while rotating in the direction indicated by a. Then, the nanofibers 11 are attracted to the rotating electric field which is generated by the rotating electric field generating unit 45 and which rotates in the direction indicated by b, and are simultaneously rotated more strongly. As a result, the nanofibers 11 are more strongly twisted and gathered. In such a manner, high strength yarn 20 which are strongly twisted is formed. By the collecting unit 5 collecting the yarn 20 by winding, the high strength and uniform yarn 20 made of nanofibers can be produced with high productivity and at a low cost.

The structure of the rotating electric field generating unit 45 is not limited to those shown in FIG. 8 to FIG. 10, but may be as described below.

Figure 11A:
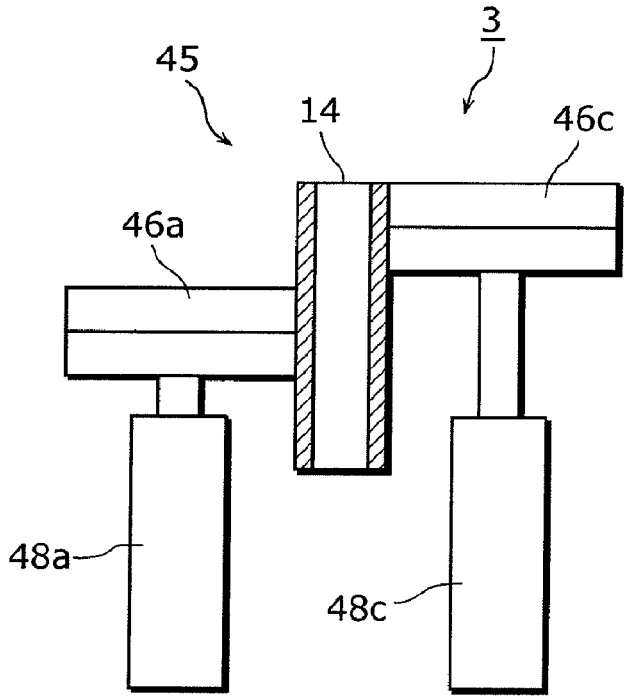
FIG. 11A is a perspective view of another example of structure of a rotating electric field generating unit of the collecting electrode unit according to the third embodiment.
Figure 11B:
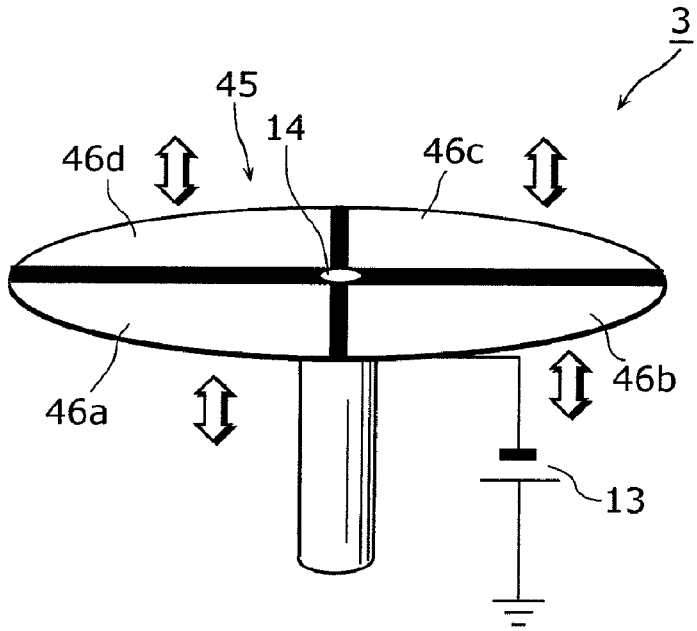
FIG. 11B is a longitudinal sectional view of the above another example of structure.

FIG. 11A is a perspective view of another example of structure of the rotating electric field generating unit 45 of the collecting electrode unit 3 according to the third embodiment of the present invention, and FIG. 11B is a longitudinal sectional view thereof.

As shown in FIG. 11A and FIG. 11B, a same level of high voltage is applied by the third high voltage generating unit 13 to each of the divided electrodes 46*a* to 46*d*. Then, the divided electrodes 46*a* to 46*d* are respectively reciprocated up and down by up-down reciprocating units 48*a* to 48*d* (only 48*a* and 48*c* are shown in FIG. 11B). This sequentially changes the up and down positions of the divided electrodes 46*a* to 46*d*, that is, the distance from the nanofiber generating unit 2 and each divided electrode 46*a* to 46*d*.

With this structure, the electric field strength between the nanofiber producing unit 2 and each divided electrode 46*a* to 46*d* sequentially changes around the through-hole 14; and thus, an electric field, which functions as if it is rotating, is formed. As a result, it is possible to obtain the effects identical to those obtained by the structure shown in FIG. 8 to FIG. 10.

Figure 12A:
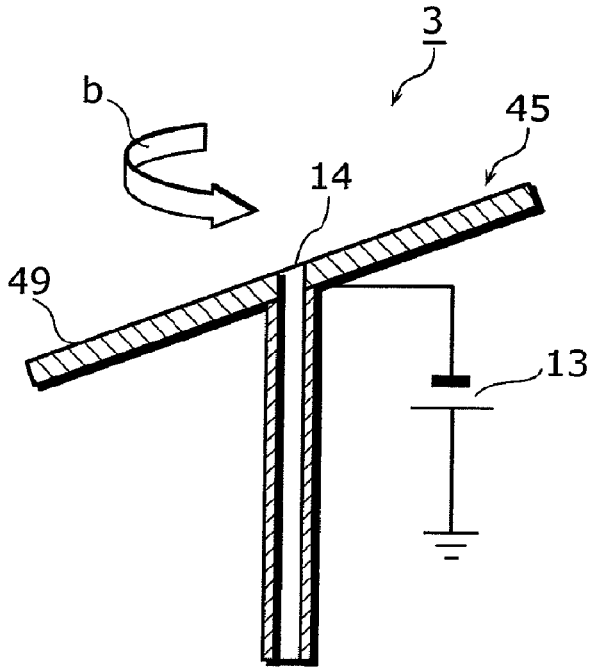
FIG. 12A is a perspective view of a further example of structure of the rotating electric field generating unit of the collecting electrode unit according to the third embodiment.
Figure 12B:
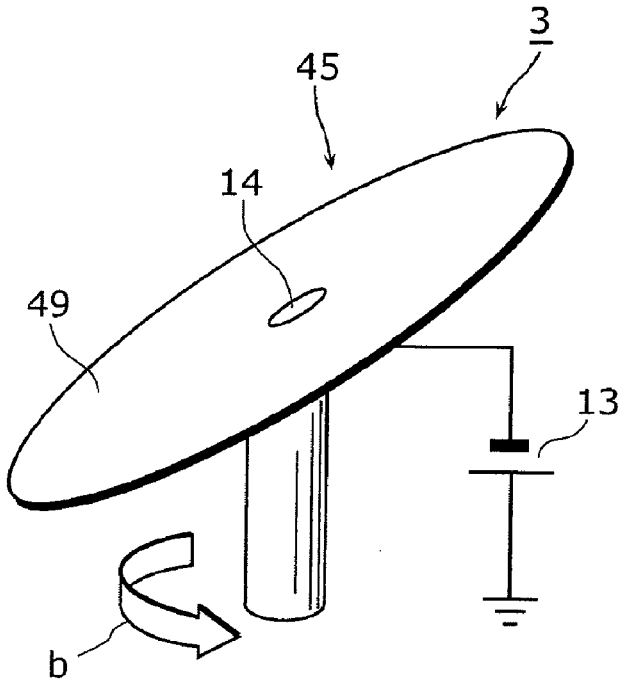
FIG. 12B is a longitudinal sectional view of the above further example of structure.

FIG. 12A is a perspective view of a further example of structure of the rotating electric field generating unit 45 of the collecting electrode unit 3 according to the third embodiment of the present invention, and FIG. 12B is a longitudinal sectional view thereof.

As shown in FIG. 12A and FIG. 12B, the rotating electric field generating unit 45 includes an inclined collecting electrode 49. The inclined collecting electrode 49 is rotated in the direction indicated by the arrow b. According to the position of rotation of the inclined collecting electrode 49, magnetic field strength between the nanofiber producing unit 2 and the inclined collecting electrode 49 changes on each part around the through-hole 14. Along with the rotation of the inclined collecting electrode 49, electric fields sequentially change around the through-hole 14, which results in forming an electric field which functions as if it is rotating. As a result, it is possible to obtain the effects identical to those obtained in the structure shown in FIG. 8 to FIG. 10.

(Fourth Embodiment)

Next, fourth embodiment of a nanofiber spinning device according to the present invention will be described with reference to FIG. 13.

Figure 13:
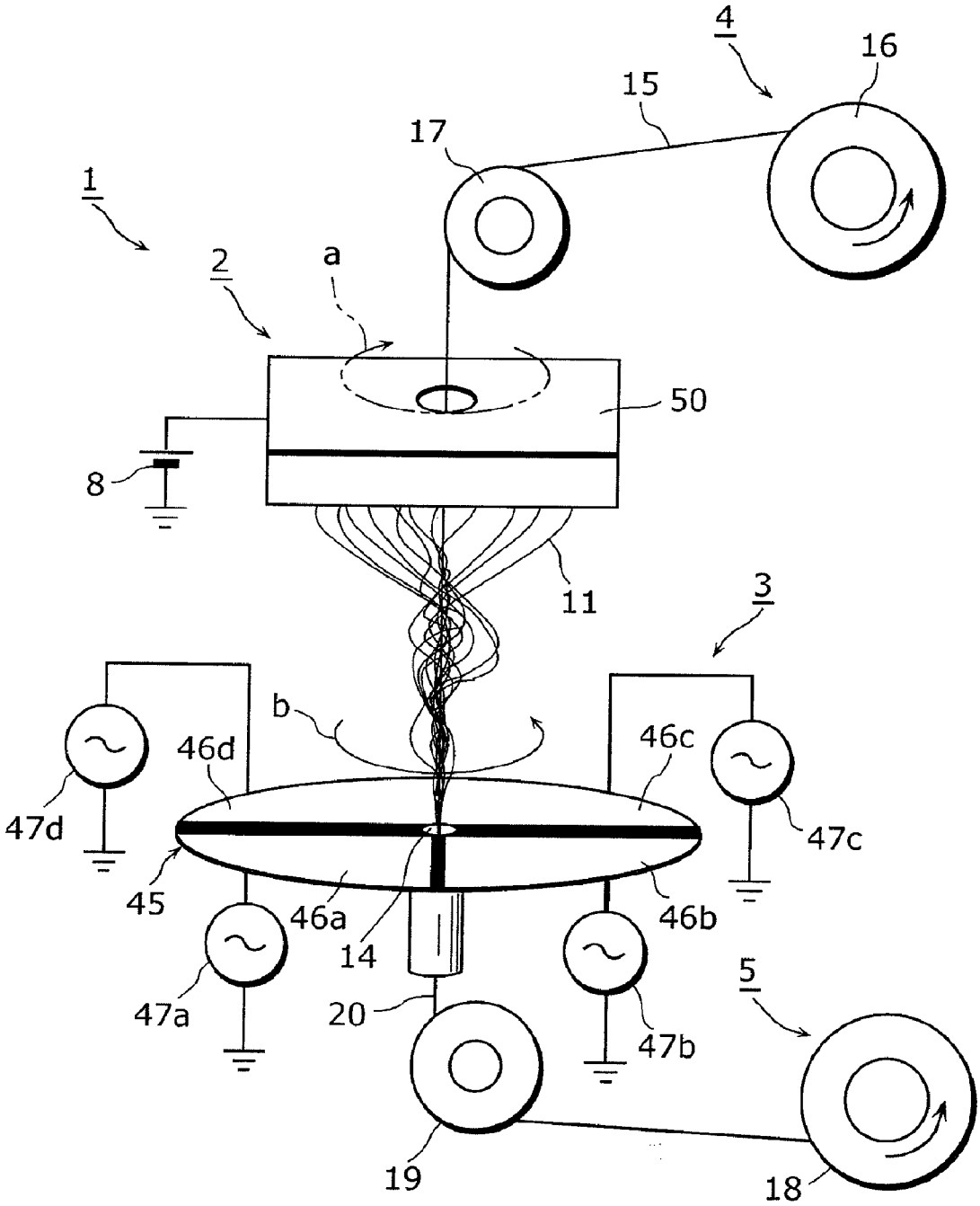
FIG. 13 is a perspective view of an overall schematic structure of a nanofiber spinning device according to a fourth embodiment of the present invention.

FIG. 13 is a perspective view of an overall schematic structure of a nanofiber spinning device according to the fourth embodiment of the present invention.

In each of the embodiments described above, an example has been shown where the nanofiber producing unit 2 includes a combination of a cylindrical container 6 which is driven to rotate and a reflecting electrode 9, or includes a cylindrical container 22 which is driven to rotate, so that the produced nanofibers 11 travel in a single direction while rotating. However, as shown in FIG. 13, in a nanofiber spinning device 1 according to the present embodiment, the nanofiber producing unit 2 produces the nanofibers 11 by causing the nanofibers 11 to travel substantially straight in a single direction (downward in the example shown in FIG. 13).

More particularly, the nanofiber producing unit 2 includes a box-shaped nanofiber producing head 50 as shown in FIG. 13. The nanofiber producing head 50 has a bottom surface provided with nozzles (now shown) for charging and extruding polymer solution. The nozzles have, for example, similar shapes as those of the nozzles 21 shown in FIG. 2. Further, any arrangement of the nozzles is possible. For example, the nozzles may be aligned in a single line, multiple lines, a matrix pattern, or a multi-ring pattern, at the bottom surface of the nanofiber producing head 50.

With this structure, the rotating electric field which is formed by the collecting electrode unit 3 and rotates in the direction indicated by the arrow b, causes the nanofibers travelling in a single direction to rotate, and the rotated nanofibers 11 are gathered. Then, the nanofibers 11 are gathered while being twisted, and spun. The formed yarn 20 is collected by the collecting unit 5 by winding.

Note that, also in the present embodiment, the nanofiber producing head 50 may rotate in the direction indicated by the arrow a with virtual line, which is a direction opposite to the direction of rotation of the rotating electric field. Although this complicates the structure, it is preferable since more strongly twisted yarn 20 can be produced.

Further, alternatively, the structure may be: the cylindrical container 6 as shown in the above embodiments is driven to rotate about its horizontal central axis; the nanofibers 11 are produced from the small holes 7 by centrifugal force and electrostatic explosions; and the nanofibers 11 are caused to travel in a single direction by a parabolic reflecting electrode (not shown) or the like provided on the outer circumferential surface of the cylindrical container 6.

Also in the present embodiment, the nanofibers 11 produced by the nanofiber producing unit 2 are rotated by the rotating electric field generated by the collecting electrode unit 3, effectively twisted and gathered, thereby producing a yarn 20. The produced yarn 20 is collected by winding by the collecting unit 5, thereby producing high strength and uniform yarn 20 made of the nanofibers 11, with high productivity and at a low cost.

(Fifth Embodiment)

Next, fifth embodiment of a nanofiber spinning device according to the present invention will be described with reference to FIG. 14 to FIG. 19.

Figure 14:
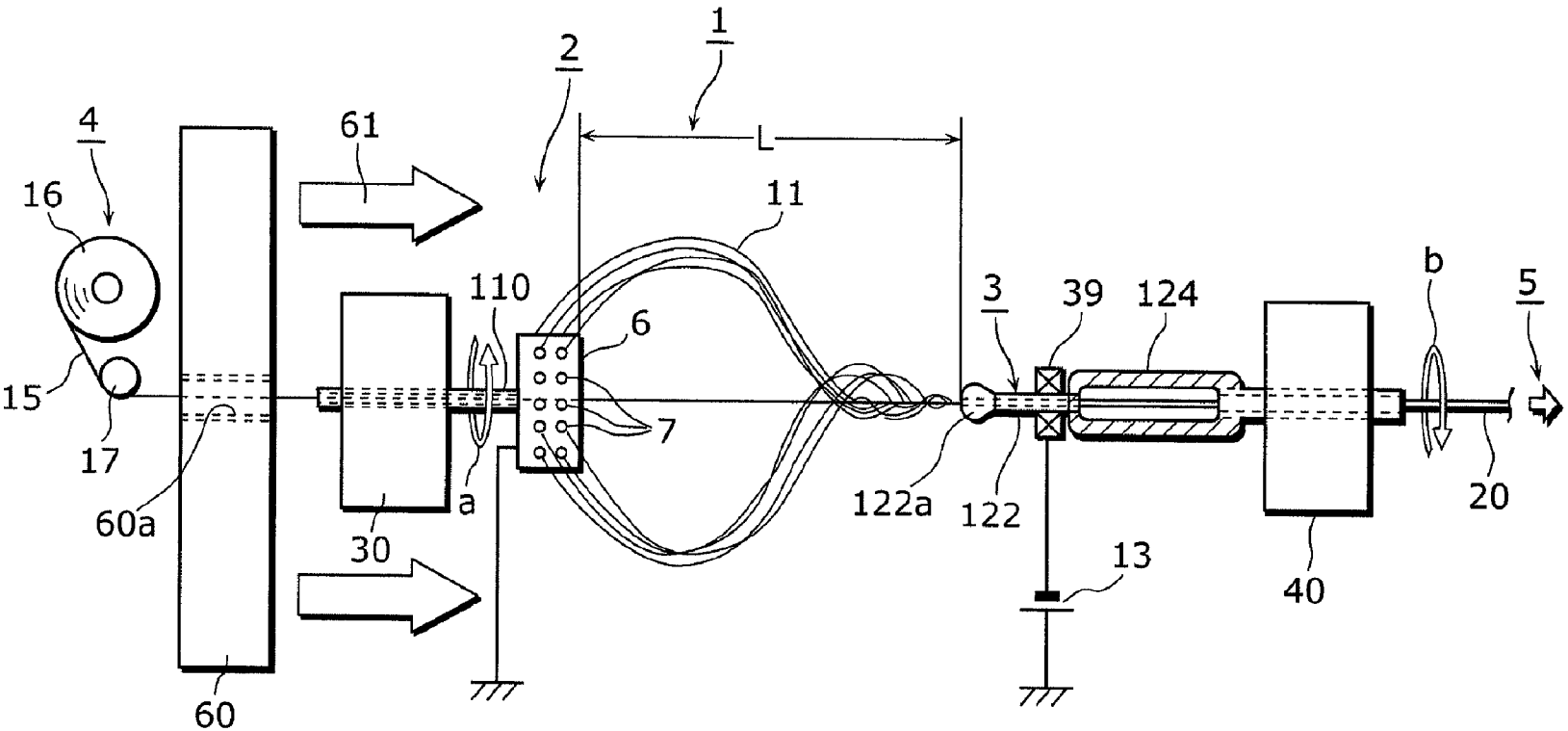
FIG. 14 is a partial cross-sectional and elevation view of an overall schematic structure of a nanofiber spinning device according to a fifth embodiment of the present invention.

FIG. 14 is a partial cross-sectional and elevation view of an overall schematic structure of a nanofiber spinning device 1 according to the fifth embodiment of the present invention.

As shown in FIG. 14, the nanofiber spinning device 1 includes a nanofiber producing unit 2 for producing nanofibers 11, a collecting electrode unit 3, a core yarn feeding unit 4, and a collecting unit 5.

The nanofiber producing unit 2 includes a cylindrical container 6 which is a rotary container pivotally supported about its horizontal central axis. The cylindrical container 6 has an outer circumferential surface formed with small holes 7. The small holes 7 each have a diameter of approximately 0.02 to 2 mm and are arranged at an interval of a few mm. The cylindrical container 6 is driven to rotate, by a rotation drive unit 30, in the direction indicated by the arrow a. For the rotation drive unit 30, a DC motor which is penetrated by an output shaft made of a hollow shaft is preferably used.

Figure 15:
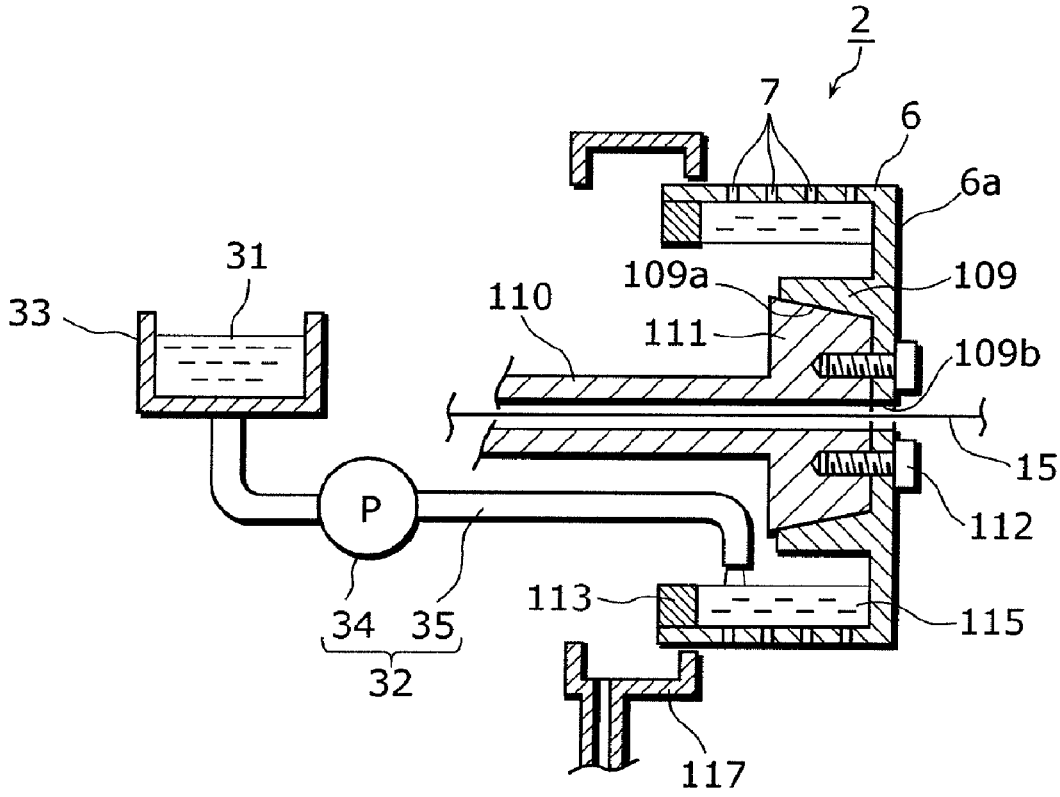
FIG. 15 is a cross-sectional view of a structure of a nanofiber producing unit according to the fifth embodiment.

FIG. 15 is a cross-sectional view of a structure of the nanofiber producing unit 2 according to the fifth embodiment of the present invention.

As shown in FIG. 15, the cylindrical container 6 has one end closed by a closed wall 6*a*. At the central axis portion of the inner surface of the closed wall 6*a*, a support boss 109 is provided. The support boss 109 includes a large-diameter tapered fitting hole 109*a* and a small-diameter through-hole 109*b*. The output axis of the rotation drive unit 30 or a hollow rotary shaft 110 connected coaxially to the output shaft has its tip provided with a large-diameter mounting portion 111 which is taper-fitted to the tapered fitting hole 109*a* of the support boss 109. The rotary container 6 is provided so as to cover the tip of the hollow rotary shaft 110. The closed wall 6*a* and the mounting portion 111 are tightly fixed by the mounting bolts 112 with the tapered fitting hole 109*a* being fitted to the mounting portion 111, so that the cylindrical container 6 is attached to the hollow rotary shaft 110.

An annular weir 113 is provided at the circumference of the inner surface of the other end of the cylindrical container 6, so that a layer of polymer solution 31 with a predetermined thickness is formed on the outer circumference of the inside of the cylindrical container 6 by centrifugal force in a state where the cylindrical container 6 is rotating. The polymer solution 31 contained in a storage container 33 is supplied at a predetermined flow rate to the cylindrical container 6 by the polymer solution supplying unit 32 including a supply pump 34 and a solution supply tube 35. The polymer solution 31 which is excessively supplied, overflows over the weir 113, and then is collected by a solution collecting unit 117 and returned to the storage container 33.

Further, as shown in FIG. 14, at the rear side of the rotation drive unit 30, which is the side opposite to the cylindrical container 6, a blowing unit 60 is provided as a unit for forcibly causing the produced nanofibers 11 to travel toward the collecting electrode unit 3. The blowing unit 60 provides gas flow 61 toward the outer circumferential surface of the rotary container 6. For such a unit, instead of the blowing unit 60, or in combination with the blowing unit 60, a reflecting electrode to which a high voltage with a polarity identical to that of the charged nanofibers 11 may be provided.

At the rear side of the blowing unit 60, the core yarn feeding unit 4 is provided. The core yarn feeding unit 4 includes a core yarn feeding roll 16 around which core yarn 15 is wound so that the core yarn 15 can be unwound, and a guide roller 17 which guides the unwound core yarn 15 so that the unwound core yarn 15 can be fed to the central axis position of the cylindrical container 6. The core yarn feeding unit 4 only needs to feed the core yarn 15, at least in the initial period of spinning, only for a certain period. The core yarn 15 unwound from the core yarn feeding unit 4 is fed toward the central axis position of the collecting electrode unit 3 through a through-hole 60*a* formed at the central axis position of the blowing unit 60, the hollow output shaft of the rotation drive unit 30, the hollow portion of the hollow rotary shaft 110, and the through-hole 109*b* of the support boss 109 of the cylindrical container 6.

The collecting electrode unit 3 is provided coaxially to the central axis of rotation of the cylindrical container 6 of the nanofiber producing unit 2 by distance L. The distance L is a distance required for a primary to tertiary and successive electrostatic explosions to take place on the polymer solution 31 extruded as filaments through the small holes 7 of the cylindrical container 6, so that the nanofibers 11 are produced.

Figure 16A:
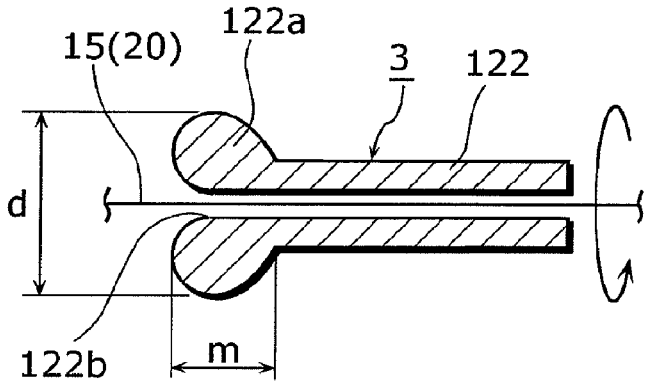
FIG. 16A is a cross-sectional view of a collecting electrode unit according to the fifth embodiment.
Figure 16B:
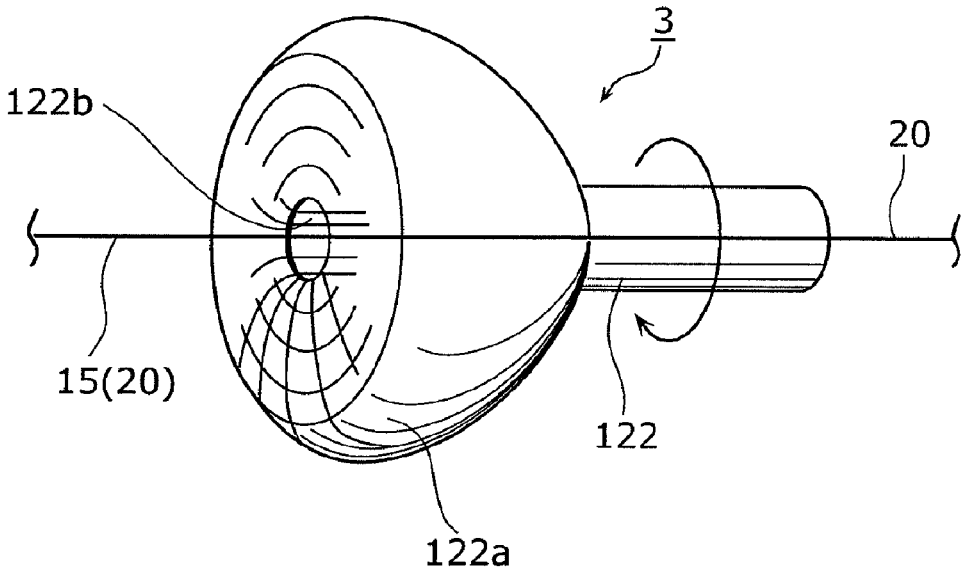
FIG. 16B is an appearance perspective view of the collecting electrode unit according to the fifth embodiment.

FIG. 16A is a cross-sectional view of the collecting electrode unit 3 according to the fifth embodiment of the present invention, and FIG. 16B is an appearance perspective view thereof.

As shown in FIG. 16A and FIG. 16B, the collecting electrode unit 3 includes a shaft 122 having an enlarged head portion 122*a* at one end which is at the position closer to the nanofiber producing unit 2. The enlarged head portion 122*a* is a rotating body which is heart-shaped viewed in cross-section and has a through-hole 122*b* at its central axis. Note that only the outer surface of the enlarged head portion 122*a* of the collecting electrode unit 3 needs to be conductive, and the other parts of the collecting electrode unit 3 are not necessarily be conductive. The through-hole 122*b* is formed so as to penetrate the shaft 122.

Further, the other end of the shaft 122, which is the opposite side of the enlarged head portion 122*a*, is pivotally supported about its central axis by a bearing 39. Further, the other end of the shaft 122 is connected to the rotation drive unit 40 via a hollow coupling 124 made of insulating materials. Thus, the collecting electrode unit 3 is driven to rotate in the direction indicated by the arrow b which is opposite to the direction a of rotation of the rotary container 6. For the rotation drive unit 40, a DC motor which is penetrated by an output shaft made of a hollow shaft is preferably used.

The yarn 20, formed of the nanofibers 11 gathered by the collecting electrode unit 3 and spun, travel toward the collecting unit 5 through the through-hole 122*b* of the collecting electrode unit 3, the hollow coupling 124, and the hollow output shaft of the rotation drive unit 40, and then are collected.

Figure 17:
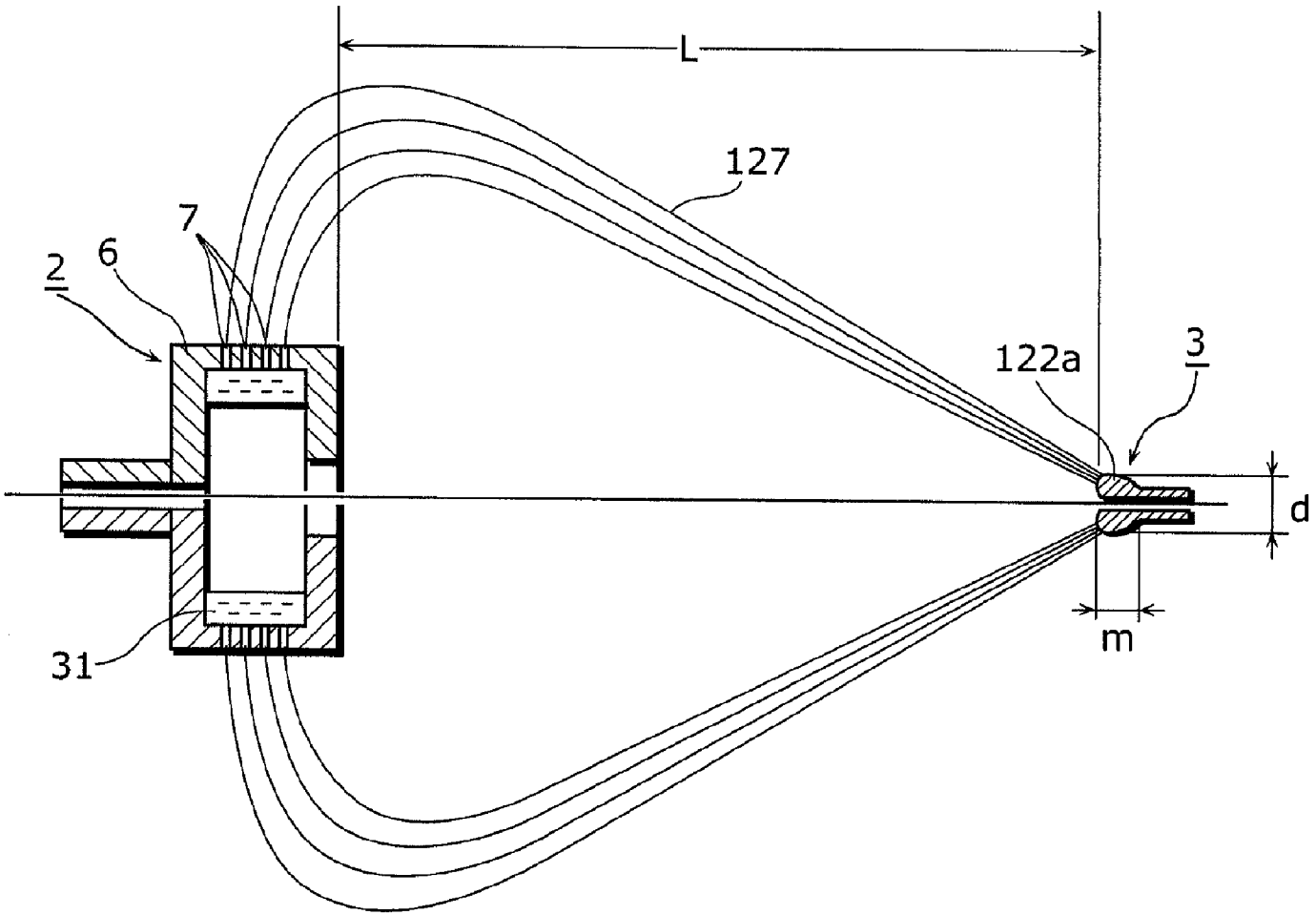
FIG. 17 is a diagram of a generating state of electric flux lines between the nanofiber producing unit and the collecting electrode unit according to the fifth embodiment.

FIG. 17 is a diagram showing a generating state of electric flux lines between the nanofiber producing unit 2 and the collecting electrode unit 3 according to the fifth embodiment of the present invention.

As shown in FIG. 17, the collecting electrode unit 3 is set such that where the distance between the cylindrical container 6 and the collecting electrode unit 3 is L, the maximum outside diameter d of the enlarged head portion 122*a* and the length m of its axial direction are both approximately L/20. It is preferable to set such that both the maximum outside diameter d of the enlarged head portion 122*a* and the length m of its axial direction are both within a range from L/20 to L/80; however, it may be set in the range from $L/10 \geqq d \geqq L/100$.

Further, as shown in FIG. 14, at least the outer circumferential surface of the cylindrical container 6 or vicinity of the small holes 7 of the cylindrical container 6 is conductive, and the cylindrical container 6 is also grounded. Further, at least the enlarged head portion 122*a* of the collecting electrode unit 3 is connected to the high voltage generating unit 13 which generates a positive or negative high voltage of 1 kV to 200 kV, preferably 10 kV to 100 kV (negative high voltage is shown in FIG. 14). As a result, an electric field is generated between the outer circumferential surface of the cylindrical container 6 and the collecting electrode unit 3.

Further, as shown in FIG. 17, the electric flux lines 127, generated by an electric field formed between the rotary container 6 and the collecting electrode unit 3, are formed such that the electric flux lines 127 travel from the outer circumferential surface of the rotary container 6 provided with the small holes 7, and gather at the annular projecting portion which is around the through-hole 122*b* of the enlarged head portion 122*a* of the collecting electrode unit 3.

The collecting electrode unit 3 is charged by a negative high voltage, and the polymer solution 31, which is extruded through the small holes 7, is charged by positive charges residing in the vicinity of the small holes 7 on the outer circumferential surface of the cylindrical container 6. Subsequently, the charged polymer solution 31 and the nanofibers 11 produced by the electrostatic explosions, are attracted to the collecting electrode unit 3 along the electric flux lines 127.

With the above structure, the polymer solution 31 is supplied into the cylindrical container 6 of the nanofiber producing unit 2, and the rotary container 6 is driven to rotate at a high speed.

As a result, the polymer solution 31 in the cylindrical container 6 is extruded as filaments through each small hole 7 under influence of centrifugal force, while being electrically charged. Then, the charged polymeric filament is further stretched due to the centrifugal force acts thereon, and as the solvent in the polymeric filaments evaporates, the diameter of the polymeric filaments decreases. Further, the electric charge residing thereon becomes concentrated. When Coulomb force exceeds the surface tension of the polymer solution, a primary electrostatic explosion takes place, and the polymeric filament is explosively stretched. Then, as the solvent further evaporates, a secondary electrostatic explosion similarly takes place, and the polymeric filament is further stretched explosively. Depending on the condition, a tertiary electrostatic explosion and so on further takes place. Consequently, nanofibers 11 that have submicron diameters and are made of polymeric substances are effectively produced.

The produced nanofibers 11 are directed from the outer circumferential surface of the rotary container 6 toward the collecting electrode unit 3 by the gas flow 61 generated by the blowing unit 60, and travel while being rotated about the central axis of the cylindrical container 6 by high speed rotation of the cylindrical container 6. Note that preferable gas flow 61 is warm air, since evaporation of solvent can be accelerated, which results in accelerating production of the nanofibers 11. The nanofibers 11, which travel along the gas flow 61 while rotating, are strongly attracted to the collecting electrode unit 3. In addition, since the collecting electrode unit 3 is rotating in the direction opposite to that of rotation of the nanofibers 11, the nanofibers 11 which travel while rotating are more strongly twisted, gathered, and spun.

Here, the maximum outside diameter d of the enlarged head portion 122*a* of the collecting electrode unit 3 is 1/10 or less of the distance L between the cylindrical container 6 and the collecting electrode unit 3, and more specifically, approximately 1/20. Thus, the electric flux lines 127 traveling from the rotary container 6 toward the collecting electrode unit 3 are stably formed such that the electric flux lines 127 are gathered around the central axis of the collecting electrode unit 3. Then, all the nanofibers 11, which travel while rotating, travel along the electric flux lines 127, are attracted to the collecting electrode unit 3. Then the nanofibers 11 are stably gathered at the central axis of the collecting electrode unit 3. In such a manner, all the nanofibers 11 are evenly twisted, and the yarn 20 having uniform diameter is produced. As a result, stable forming of the high strength yarn 20 with high productivity is possible. The formed yarn 20 is collected by the collecting unit 5 via the through-hole 122*b* of the collecting electrode unit 3.

Further, the effects of twisting, gathering, and spinning of the nanofibers 11 which travel while rotating, may be unstable at least when spinning starts and in the initial period of spinning. Thus, before starting spinning, the core yarn 15 is unwound from the core yarn feeding unit 4, and is made to pass through the central axis of the nanofiber producing unit 2 and the collecting electrode unit 3. Then, the tip of the core yarn 15 is connected to the collecting unit 5. By operating the nanofiber producing unit 2 and the collecting electrode unit 3 in such a state, the nanofibers 11 are produced, travel toward the collecting electrode unit 3 while rotating, and start to be gathered as they become closer to the collecting electrode unit 3. At this time, operating the collecting unit 5 allows the nanofibers 11 which is gathered while traveling to tangle around the core yarn 15 and to be gathered at once. Thereby, the nanofibers 11 are reliably spun around the core yarn 15, and the yarn 20 is formed, and collected.

Once collecting the yarn 20 by the collecting unit 5 becomes stable, even without feeding the core yarn 15, the nanofibers 11 gathered earlier and being spun are tangled around by the successive nanofibers 11, thereby the nanofibers 11 are spun. Thus, the nanofibers 11 which are being spun serve as the core yarn 15, which allows spinning of the nanofibers 11 without feeding of the core yarn 15 by the core yarn feeding unit 4. Note that in the case of forming yarn having the core yarn 15 at the center, of course, the core yarn 15 may be continuously fed.

In the examples shown in FIG. 14 and FIG. 15, the cylindrical container 6 having the small holes 7 on its circumferential surface is used; however, it may be that short nozzles are provided at a suitable intervals on the circumferential surface of the cylindrical container 6, and the nozzle holes formed in the short nozzles serve as the small holes 7.

Further, the collecting electrode unit 3 does not necessarily include the shaft 122 having the enlarged head portion 122*a* and the through-hole 122*b*. Alternatively, it may be that the collecting electrode unit 3 includes a collecting electrode 24 having the through-hole 24*a* at its central axis as shown in FIG. 5A and FIG. 5B. Since the collecting electrode 24 includes a through-hole 24*a* which is similar to the through-hole 122*b* of the shaft 122, the collecting electrode unit 3 can obtain the same effects obtained in the case of inclusion of the shaft 122.

Figure 18:
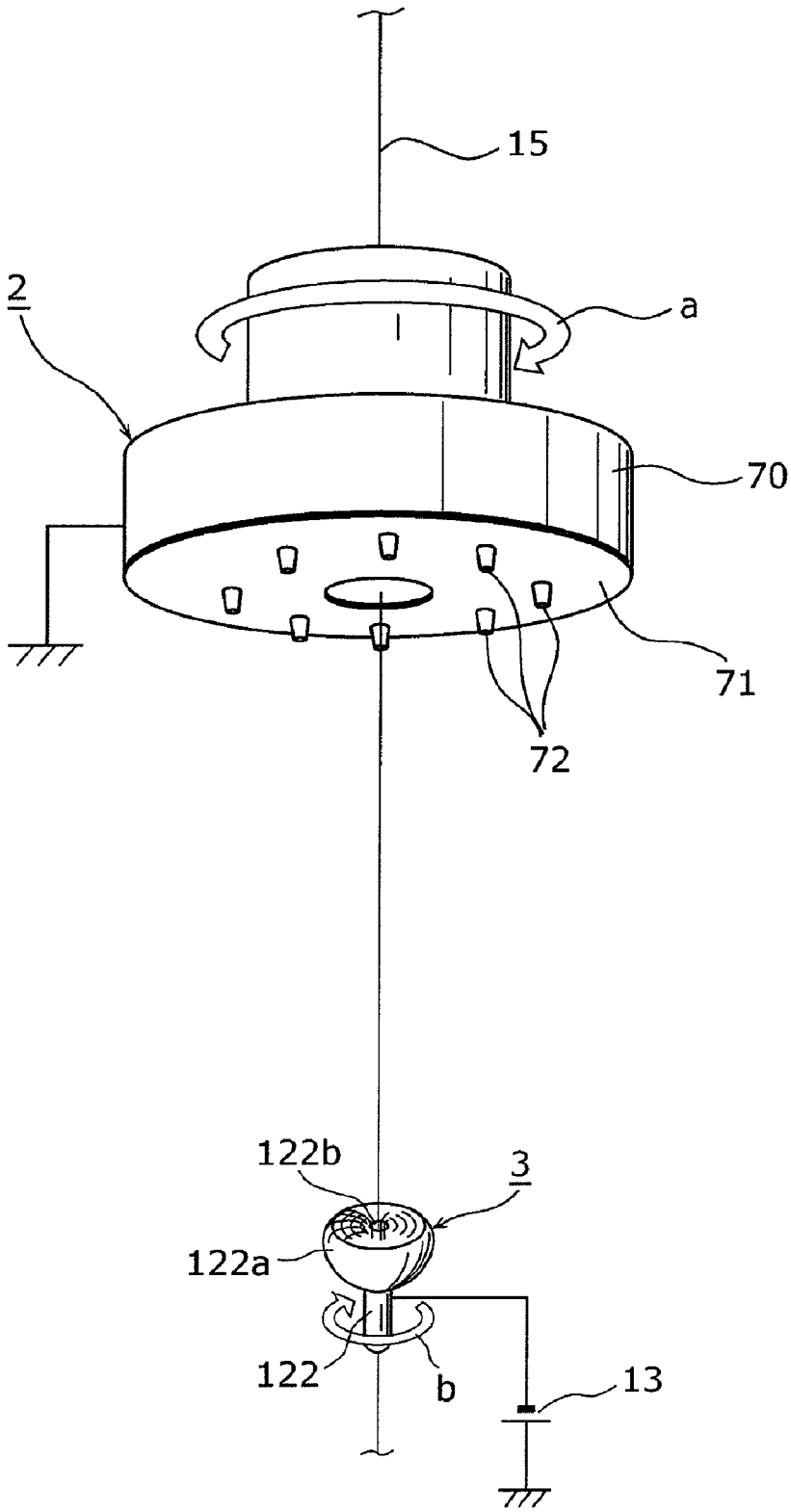
FIG. 18 is a perspective view of another example of structure of the nanofiber spinning device according to the fifth embodiment.

FIG. 18 is a perspective view of another example of structure of the nanofiber spinning device 1 according to the fifth embodiment of the present invention.

As shown in FIG. 18, the nanofiber producing unit 2 can be driven to rotate pivotally about its vertical central axis, and includes a cylindrical container 70 provided with nozzles 72 or small holes at the bottom surface 71.

Figure 19:
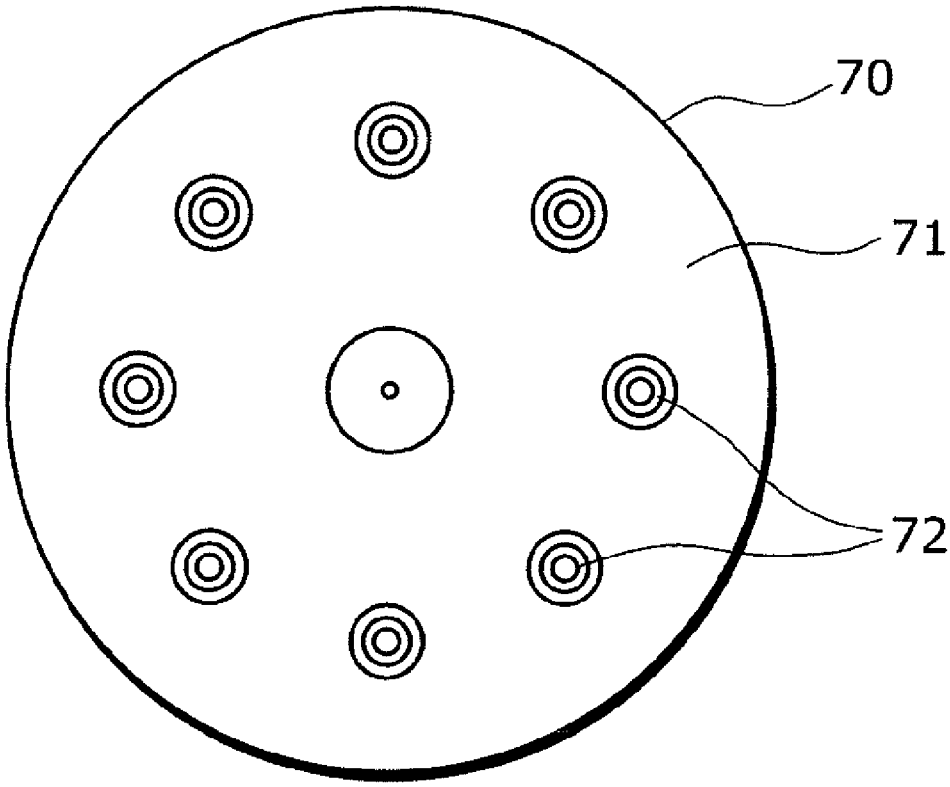
FIG. 19 is a bottom view of a cylindrical container according to the above another example of structure.

FIG. 19 is a bottom view of the cylindrical container of the another example of structure shown in FIG. 18.

As shown in FIG. 19, it is preferable that the nozzles 72 are circumferentially arranged at a predetermined interval on the outer circumference of the end surface 71; however, the nozzles 72 may be dispersed at a predetermined interval on the entire surface of the end surface 71. The collecting electrode unit 3 is coaxially provided immediately below the cylindrical container 70 with a predetermined distance. The cylindrical container 70 is grounded, and the collecting electrode unit 3 is connected to the high voltage generating unit 13.

In the present example of structure, a high voltage is also applied to the collecting electrode unit 3, so that an electric field is generated between the collecting electrode unit 3 and the cylindrical container 70. As the cylindrical container 70 rotates in the direction indicated by the arrow a, the collecting electrode unit 3 rotates in the direction indicated by the arrow b. By the polymer solution 31 being supplied to the cylindrical container 70, the polymer solution 31 is extruded through the nozzles 72 while rotating, and simultaneously explosively stretched by the electrostatic explosions. As a result, the nanofibers 11 are produced. Then, the produced nanofibers 11 rotates while travelling toward the collecting electrode unit 3 along the electric flux lines 127 generated between the cylindrical container 70 and the collecting electrode unit 3. At this time, the nanofibers 11 are attracted to the circumference of the through-hole 122*b* of the enlarged head portion 122*a* of the collecting electrode unit 3, thereby providing a stable gathering of the nanofibers 11 at the central axis of the collecting electrode unit 3. In such a manner, all the nanofibers 11 are evenly twisted, and the yarn 20 having uniform diameter is produced. As a result, stable forming of the high strength yarn 20 with high productivity is possible.

In the present example of structure, it has been described that the cylindrical containers 6 and 70 of the nanofiber producing unit 2 rotate in the direction indicated by the arrow a, and the collecting electrode unit 3 rotates in the direction indicated by the arrow b which is opposite to the direction a. However, it may be that the nanofiber producing unit 2 does not rotate, but only the collecting electrode unit 3 rotates. Alternatively, it may also be that the collecting electrode unit 3 does not rotate, but only the nanofiber producing unit 2 rotates.

Further, in the present example of structure, it has been described that the nanofiber producing unit 2 is grounded, and a high voltage is applied to the collecting electrode unit 3, so that an electric field is generated between the nanofiber producing unit 2 and the collecting electrode unit 3. However, it may be that a high voltage is applied to the nanofiber producing unit 2, and the collecting electrode unit 3 is electrically grounded. Alternatively, it may also be that high voltage with opposite polarity are applied to the nanofiber producing unit 2 and the collecting electrode unit 3. In other words, it is only necessary that a high potential difference is applied between the nanofiber producing unit 2 and the collecting electrode unit 3 so that an electric field is generated therebetween.

The nanofiber spinning method and device according to the present invention have been described using the above described embodiments; however, the present invention is not limited thereto.

For example, in the described embodiments, the core yarn 15 is fed at least for a certain period in the initial period of spinning; however, it may be that the nanofibers 11 may be continuously wound around the core yarn 15. Such application of continuously winding the nanofibers 11 around the core yarn 15 is an effective way to produce the nanofibers 11 wound around the core yarn 15.

Further, in the described embodiments, a high voltage is applied to the rotary container, collecting electrode and the like, by the high voltage generating unit via a bearing; however, a method of applying high voltage is not limited thereto. For example, by applying a high voltage to a rotating object via a slip ring or a brush, reliability can be further improved.

According to a nanofiber spinning method and device of the present invention, nanofibers made of polymeric substances can be produced by an electrospinning method. The produced nanofibers are attracted to the collecting electrode unit while being rotated, and then are gathered; thereby forming twisted high strength yarn. Further, since the yarn is collected by the collecting unit through winding, a uniform and high strength yarn can be produced with high productivity and at a low cost. The present invention can be preferably used for production of high strength yarn made of nanofibers.

The invention claimed is:

1. A nanofiber spinning method comprising:

producing nanofibers by extruding polymer solution through small holes and charging the polymer solution, and by allowing the polymer solution to be stretched by an electrostatic explosion, the polymer solution being prepared by dissolving a polymeric substance in a solvent;

twisting and gathering the nanofibers, which have been produced, by causing a collecting electrode unit to attract the nanofibers and simultaneously rotate the nanofibers, the collecting electrode unit having an electric potential different from an electric potential of the polymer solution which has been charged; and collecting the nanofibers, which have been twisted, by winding, wherein the collecting electrode unit includes a collecting electrode having a center provided with a through-hole through which the nanofibers pass, and in said twisting, the collecting electrode is rotated about a central axis of the collecting electrode so that the nanofibers, which have been produced, are rotated and twisted.

2. The nanofiber spinning method according to claim 1, wherein, in said twisting, the nanofibers, which have been produced and are travelling toward the collecting electrode unit, are rotated about a central axis along a direction of travel of the nanofibers, in a direction opposite to a direction of rotation of the nanofibers caused by the collecting electrode unit.

3. A nanofiber spinning method comprising:

producing nanofibers by extruding polymer solution through small holes and charging the polymer solution, and by allowing the polymer solution to be stretched by an electrostatic explosion, the polymer solution being prepared by dissolving a polymeric substance in a solvent;

twisting and gathering the nanofibers, which have been produced, by causing a collecting electrode unit to attract the nanofibers and simultaneously rotate the nanofibers, the collecting electrode unit having an electric potential different from an electric potential of the polymer solution which has been charged; and collecting the nanofibers, which have been twisted, by winding, wherein the collecting electrode unit includes a collecting electrode around a through-hole which is provided at a center of the collecting electrode unit and through which the nanofibers pass, and in said twisting, the collecting electrode forms a rotating electric field, so that the nanofibers, which have been produced, are rotated and twisted.

4. The nanofiber spinning method according to claim 1, further comprising:

at least in an initial period of spinning, feeding a core yarn through a central axis of rotation of the nanofibers which are rotated and gathered in said twisting, wherein, in said collecting, the core yarn is wound together with the nanofibers.

* * * * *